US011443690B2

(12) United States Patent
Lee et al.

(10) Patent No.: US 11,443,690 B2
(45) Date of Patent: Sep. 13, 2022

(54) METHOD FOR CALCULATING DEGREE OF DEGRADATION ON BASIS OF PROPERTIES OF IMAGE DISPLAYED ON DISPLAY AND ELECTRONIC DEVICE FOR IMPLEMENTING SAME

(71) Applicant: SAMSUNG ELECTRONICS CO., LTD., Suwon-si (KR)

(72) Inventors: Yohan Lee, Suwon-si (KR); Seungkyu Choi, Suwon-si (KR); Yunpyo Hong, Suwon-si (KR); Hanyuool Kim, Suwon-si (KR); Jongkon Bae, Suwon-si (KR); Younghee Ha, Suwon-si (KR); Dongkyoon Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/266,013

(22) PCT Filed: Jun. 4, 2019

(86) PCT No.: PCT/KR2019/006687
§ 371 (c)(1),
(2) Date: Feb. 4, 2021

(87) PCT Pub. No.: WO2020/032369
PCT Pub. Date: Feb. 13, 2020

(65) Prior Publication Data

US 2021/0295771 A1 Sep. 23, 2021

(30) Foreign Application Priority Data

Aug. 8, 2018 (KR) ..... 10-2018-0092706

(51) Int. Cl.
*G09G 3/3208* (2016.01)
*G09G 3/00* (2006.01)
(Continued)

(52) U.S. Cl.
CPC ..... *G09G 3/3208* (2013.01); *G04G 19/12* (2013.01); *G09G 3/00* (2013.01); *G09G 5/38* (2013.01);
(Continued)

(58) Field of Classification Search
None
See application file for complete search history.

(56) References Cited

U.S. PATENT DOCUMENTS 8,872,740 B2 10/2014 Yamashita et al.
9,812,067 B2 11/2017 Yang et al.
(Continued)

FOREIGN PATENT DOCUMENTS

JP 2000-356981 12/2000
JP 2002-175041 6/2002
(Continued)

OTHER PUBLICATIONS

International Search Report for PCT/KR2019/006687 dated Sep. 17, 2019, 4 pages.
(Continued)

*Primary Examiner* — Patrick F Valdez
(74) *Attorney, Agent, or Firm* — Nixon & Vanderhye, P.C.

(57) ABSTRACT

Disclosed is an electronic device comprising at least one sensor, a communication circuit, a display, and at least one processor operationally connected to the display, wherein the at least one processor is configured to: display, on the display, a watch screen including a fixed element displayed at a designated location on the display, a repetitive element
(Continued)

displayed on the basis of at least a designated rule, and a changing element associated with information obtained through the at least one sensor or received through the communication circuit; generate first data on the basis of at least one of the designated rule or the shape of the repetitive element; generate second data based on at least one of the fixed element or the changing element, in response to the changing element changing from a first value to a second value; and generate first deterioration information on the basis of the first data, the second data, and the duration over which the changing element maintains the first value. Various other embodiments understood through the specification are also possible.

8 Claims, 15 Drawing Sheets

(51) Int. Cl.
*G04G 19/12* (2006.01)
*G09G 5/38* (2006.01)
*G04G 9/00* (2006.01)

(52) U.S. Cl.
CPC ..... *G04G 9/007* (2013.01); *G09G 2320/0257* (2013.01); *G09G 2354/00* (2013.01); *G09G 2360/145* (2013.01)

(56) References Cited

U.S. PATENT DOCUMENTS

| | | | | |
|---|---|---|---|---|
| 9,940,872 | B2 | 4/2018 | An et al. | |
| 10,163,389 | B2 | 12/2018 | An et al. | |
| 10,431,148 | B2 | 10/2019 | Kim et al. | |
| 2014/0111525 | A1 | 4/2014 | Odaka et al. | |
| 2015/0325213 | A1* | 11/2015 | Lee | G09G 3/3208 345/213 |
| 2016/0274738 | A1* | 9/2016 | Hsiao | G06F 1/3275 |
| 2017/0153606 | A1* | 6/2017 | Pitis | G09G 5/377 |

FOREIGN PATENT DOCUMENTS

| | | | |
|---|---|---|---|
| JP | 2006195310 | A * | 7/2006 |
| JP | 2014-085457 | | 5/2014 |
| JP | 5696463 | | 4/2015 |
| JP | 2017159745 | A * | 9/2017 |
| KR | 10-1588449 | | 1/2016 |
| KR | 10-2016-0026628 | | 3/2016 |
| KR | 10-2016-0072886 | | 6/2016 |
| KR | 10-2017-0067189 | | 6/2017 |
| KR | 10-2017-0067200 | | 6/2017 |
| KR | 10-2017-0137456 | | 12/2017 |

OTHER PUBLICATIONS

Written Opinion of the ISA for PCT/KR2019/006687 dated Sep. 17, 2019, 5 pages.

* cited by examiner

METHOD FOR CALCULATING DEGREE OF DEGRADATION ON BASIS OF PROPERTIES OF IMAGE DISPLAYED ON DISPLAY AND ELECTRONIC DEVICE FOR IMPLEMENTING SAME

This application is the U.S. national phase of International Application No. PCT/KR2019/006687 filed Jun. 4, 2019 which designated the U.S. and claims priority to KR Patent Application No. 10-2018-0092706 filed Aug. 8, 2018, the entire contents of each of which are hereby incorporated by reference.

FIELD

Embodiments disclosed in the disclosure relate to a technology for compensating for the deterioration of a display by collecting and analyzing information about the deterioration generated by a plurality of elements displayed on a screen of the display.

DESCRIPTION OF RELATED ART

An electronic device includes a display that displays a screen. Nowadays, a wearable electronic device (e.g., a smart watch) capable of being worn by a user among electronic devices is being widely used. The electronic device may provide an always-on-display (AOD) function that displays a screen regardless of whether a user utilizes the electronic device. When the AOD function is performed on the electronic device, a specific region of the screen may be maintained to be displayed at all times. The AOD may continuously display various types of information (e.g., time, weather, battery states, or notifications).

In the meantime, for example, in the case of an organic light emitting diode (OLED), when displaying a specific part of the screen for a long time, the display that displays the screen may be deteriorated and an afterimage may occur depending on the type of a display panel. When deterioration or burn-in occurs in a light-emitting element constituting the pixel of the display, the luminance of the pixel may be reduced, and thus image representation may be uneven.

SUMMARY

An electronic device to which the conventional afterimage compensation technology is applied may sample image data or current data according to a screen in units of frames, and then may accumulate the data calculated in the previous frame. When data is sampled in units of frames, the data according to the change in a screen may be accurately calculated. However, whenever the sampling is performed, the display driver integrated circuit (DDI) may need to access a processor or a memory to process or store data. When the electronic device samples data in a short period, the power consumed when the DDI accesses the processor or the memory may increase. Besides, the amount of data to be accumulated and recorded may become vast as the screen resolution and/or usage time increases.

Embodiments disclosed in this specification are intended to provide the electronic device for solving the above-described problem and problems brought up in this specification.

According to an embodiment disclosed in this specification, an electronic device may include at least one sensor, a communication circuit, a display, and at least one processor operationally connected to the display. The at least one processor may be configured to display, on the display, a watch screen including a fixed element displayed at a specified location of the display, a repeating element displayed based at least on a pre-defined rule, and a changing element associated with information obtained through the at least one sensor or received through the communication circuit, to generate first data based on at least one of the pre-defined rule or a shape of the repeating element, to generate second data based on at least one of the fixed element or the changing element in response to the changing element changed from a first value to a second value, and to generate first deterioration information based on the first data, the second data, and a time during which the changing element retains the first value.

Furthermore, according to an embodiment disclosed in this specification, an electronic device may include a display, a display driver integrated circuit (DDI) for displaying a first image including at least one first image object indicating event information and a second image including at least one second image object, of which a shape is capable of being changed, through the display while the second image is superimposed on the first image, and at least one processor. The at least one processor may be configured to identify specified event information corresponding to a change in the at least one first image object, to update the at least one first image object in response to the specified event information, to generate first deterioration information associated with a deterioration degree of the display in response to the specified event information based on a time displayed through the display before the specified event information is generated, and a change history of the shape of the at least one second image object during the time, and to accumulate the first deterioration information and second deterioration information corresponding to the first image in associated with the deterioration degree, in third deterioration information, in which information associated with the deterioration degree is accumulated.

Moreover, according to an embodiment disclosed in this specification, an electronic device may include at least one sensor, a communication circuit, a display, and at least one processor operationally connected to the display. The at least one processor may be configured to display, on the display, a screen including a first element displayed at a specified location of the display, a second element displayed based at least on a pre-defined rule, and a third element associated with information obtained through the at least one sensor or received through the communication circuit and to generate deterioration information based on the first element, the third element, data obtained by applying a pre-defined rule to the second element, and a time in which the third element has the first value, in response to the third element changed from a first value to a second value.

According to various embodiments disclosed in the disclosure, the power consumption of an electronic device may be reduced by reducing the number of times that a DDI accesses a processor or a memory.

Moreover, according to various embodiments disclosed in the disclosure, the electronic device may generate accurate deterioration information in response to changes in elements displayed on a screen.

Furthermore, according to various embodiments disclosed in the disclosure, the electronic device may not generate redundant data for repeating elements, and thus unnecessary data sampling task may be reduced. In addition, the electronic device may compensate for the unevenness of the image representation according to the degradation of a display, by processing a small amount of data.

Besides, a variety of effects directly or indirectly understood through the specification may be provided.

With regard to description of drawings, the same or similar components will be marked by the same or similar reference signs.

DETAILED DESCRIPTION OF EXAMPLE EMBODIMENTS

Hereinafter, various embodiments of the disclosure will be described with reference to accompanying drawings. However, it should be understood that this is not intended to limit the disclosure to specific implementation forms and includes various modifications, equivalents, and/or alternatives of embodiments of the disclosure.

Figure 1:
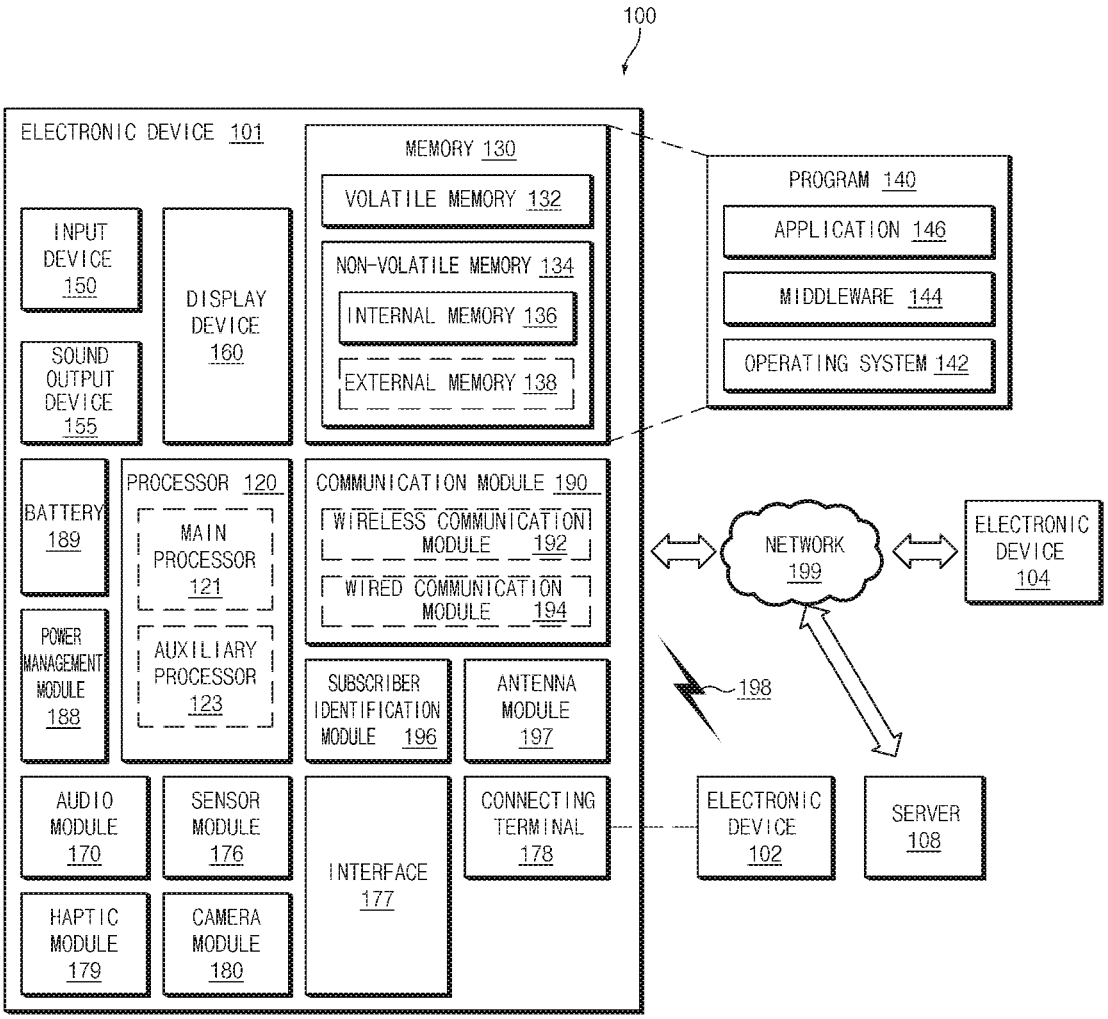
FIG. 1 is a block diagram illustrating an electronic device in a network environment, calculating degree of degradation on basis of properties of image displayed on display, according to various embodiments.

FIG. 1 is a block diagram illustrating an electronic device 101 in a network environment 100, calculating degree of degradation on basis of properties of image displayed on display, according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
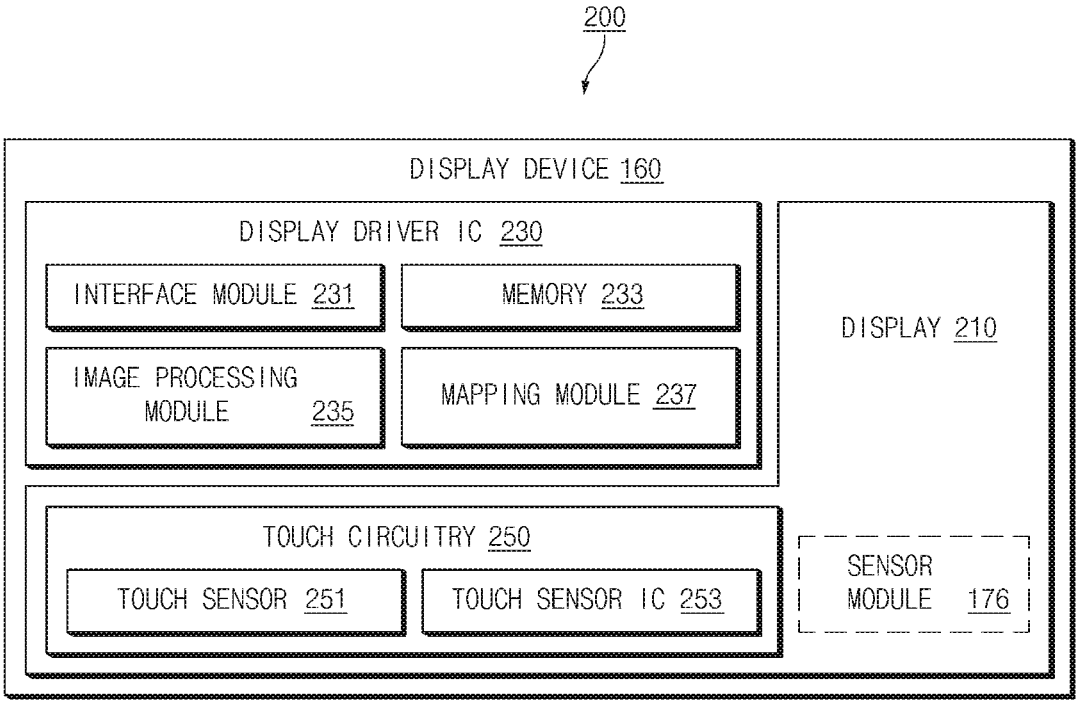
FIG. 2 is a block diagram illustrating the display device, calculating degree of degradation on basis of properties of image displayed on display, according to various embodiments.

FIG. 2 is a block diagram 200 illustrating the display device 160, calculating degree of degradation on basis of properties of image displayed on display according to various embodiments. Referring to FIG. 2, the display device 160 may include a display 210 and a display driver integrated circuit (DDI) 230 to control the display 210. The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 150 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The mapping module 237 may generate a voltage value or a current value corresponding to the image data pre-processed or post-processed by the image processing module 235. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

According to an embodiment, the display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, for example, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 150)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

Figure 3A:
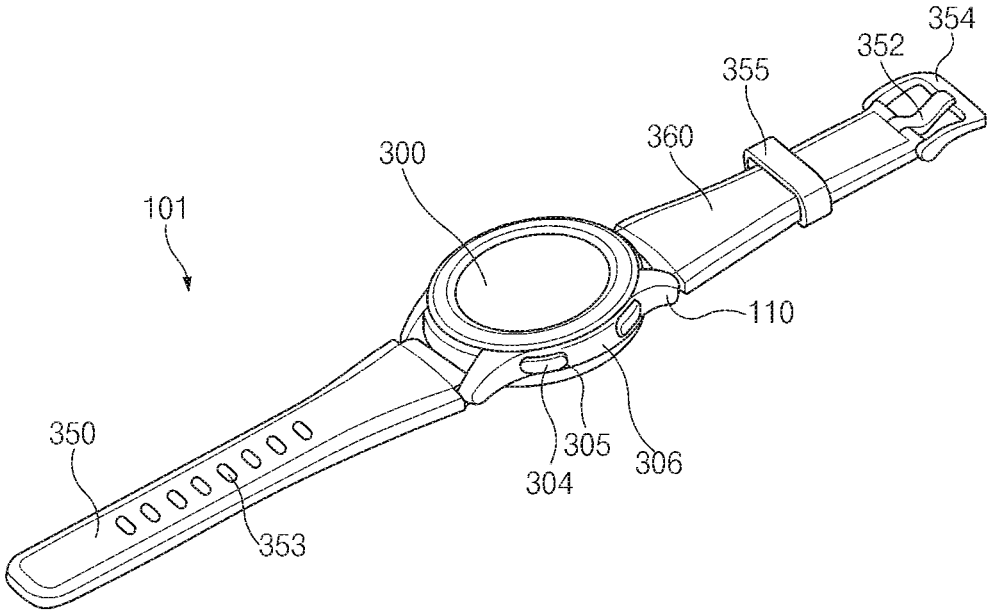
FIG. 3A is a front perspective view of an electronic device according to an embodiment.
Figure 3B:
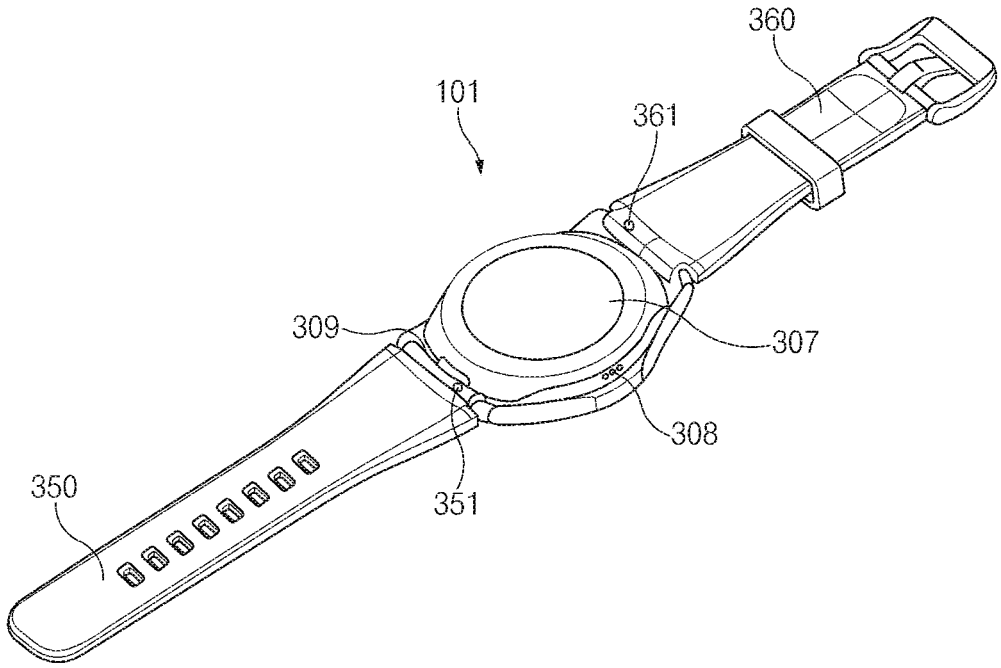
FIG. 3B is a back perspective view of an electronic device according to an embodiment.

FIG. 3A is a front perspective view of the electronic device 101 according to an embodiment. FIG. 3B is a back perspective view of the electronic device 101 according to an embodiment.

According to an embodiment, the electronic device 101 may be a wearable electronic device that a user is capable of wearing while carrying. In this specification, the wearable electronic device may be referred to as the electronic device 101. For example, as illustrated in FIGS. 3A and 3B, the electronic device 101 may be a smart watch that displays information such as time, weather, a battery, and a notification among wearable electronic devices. However, the embodiment is not limited thereto, and the electronic device 101 may be a smart watch, a smart glass, a chest pad measuring a heart rate, or an earbud. Furthermore, the electronic device 101 may be a portable electronic device such as a mobile phone or a tablet other than a wearable electronic device. In this specification, it is described that the wearable electronic device is a representative example of the electronic device 101. However, the same description may be applied to a mobile phone or a tablet within a range that is apparent to those skilled in the art.

According to an embodiment, the electronic device 101 may include a housing 110 surrounding the rear surface, the side surface, and the front surface of a watch screen 300, and binding members 350 and 360, which are connected to at least part of the housing 110 and for detachably binding the electronic device 101 to a user's body part (e.g., a wrist, an ankle, or the like). In FIGS. 3A and 3B, it is illustrated that the electronic device 101 includes the binding members 350 and 360. In an embodiment, it may mean that a wearable device or an electronic device is only the body including the display, excluding the binding members 350 and 360.

According to an embodiment, the front surface of the housing 110 may be implemented with a front plate (e.g., a glass plate including various coating layers, or a polymer plate), at least part of which is substantially transparent. The rear surface of the housing 110 may be formed by a rear plate 307 which is substantially opaque. For example, the rear plate 307 may be implemented with a coated or colored glass, a ceramic, a polymer, a metal (e.g., aluminum, stainless steel (STS), or magnesium), or the combination of at least two of the materials. The side surface of the housing 110 may be coupled with the front plate or the rear plate 307 and may be implemented with a side bezel structure (or a "side member") 306 including a metal and/or a polymer. The rear plate 307 and the side bezel structure 306 may be integrally formed and may include the same material (e.g., a metal material such as aluminum).

According to an embodiment, the binding members 350 and 360 may be formed in various materials and shapes. The binding members 350 and 360 may be formed such that the integral type and a plurality of unit links of the binding members 350 and 360 are capable of being moved with each other by woven fabric, leather, rubber, urethane, metal, ceramic, or the combination of at least two of the materials.

According to an embodiment, the electronic device 101 may include at least one or more of the watch screen 300, audio modules 305 and 308, a sensor module (e.g., the sensor module 176 of FIG. 2), a key input device 304, and a connector hole 309. For example, the electronic device 101 may not include at least one (e.g., the key input device 304, the connector hole 309, or the sensor module 176) of the components or may further include any other component.

According to an embodiment, the watch screen 300 may be exposed through a significant portion of the front plate. The shape of the watch screen 300 may be a shape corresponding to the shape of the front plate. For example, the watch screen 300 may have various shapes such as a circle, an oval, a rectangle, a rectangle with rounded corners, a polygon, or the like. The watch screen 300 may be coupled to a touch sensing circuit, a pressure sensor capable of measuring the intensity (or pressure) of a touch, and/or a fingerprint sensor or may be disposed adjacent thereto.

According to an embodiment, the audio modules 305 and 308 may include the microphone hole 305 and the speaker hole 308. A microphone for obtaining external sound may be disposed inside the microphone hole 305; in any embodiment, a plurality of microphones may be disposed inside the microphone hole 305. The speaker hole 308 may be used as an external speaker and a call receiver. In any embodiment, the speaker hole 308 and the microphone hole 305 may be implemented with one hole, or a speaker (e.g., a piezo speaker) may be included without the speaker hole 308.

According to an embodiment, the sensor module 176 may generate an electrical signal or a data value that corresponds to an internal operation state of the electronic device 101 or corresponds to an external environment state. The sensor module 176 may be disposed inside the housing 110 of the electronic device 101. The sensor module 176 may include at least one or more of a biometric sensor (e.g., a HRM sensor), a gesture sensor, a gyro sensor, a barometric pressure sensor, a magnetic sensor, an acceleration sensor, a grip sensor, a color sensor, an infrared (IR) sensor, a temperature sensor, a humidity sensor, or an illumination sensor.

According to an embodiment, the key input device 304 may be a side key button disposed on the side surface of the housing 110. In another embodiment, the electronic device 101 may include key input devices 304 and a soft key on the display.

According to an embodiment, the connector hole 309 may include other connector holes capable of accommodating a connector (e.g., a USB connector) for transmitting/receiving power and/or data with an external electronic device and accommodating a connector for transmitting/receiving an audio signal with the external electronic device. For example, the electronic device 101 may further include a connector cover that covers at least part of the connector hole 309 and blocks the inflow of external foreign substances to the connector hole.

According to an embodiment, the binding members 350 and 360 may be detachably bound to at least a partial region of the housing 110, using locking members 351 and 361. The binding members 350 and 360 may include at least one or more of a fixing member 352, a fixing member fastening hole 353, a band guide member 354, and a band fixing ring 355.

According to an embodiment, the fixing member 352 may be configured to fix the housing 110 and the binding members 350 and 360 to the user's body part (e.g., a wrist, an ankle, or the like). The fixing member fastening hole 353 may fix the housing 110 and the binding members 350 and 360 to the user's body part in compliance with the fixing member 352. The band guide member 354 may be configured to limit the moving range of the fixing member 352 when the fixing member 352 is fastened with the fixing member fastening hole 353, and thus may allow the binding members 350 and 360 to be bound to the user's body part while being in close contact. In a state where the fixing member 352 is fastened to the fixing member fastening hole 353, the band fixing ring 355 may limit the moving range of the binding members 350 and 360.

Figure 3C:
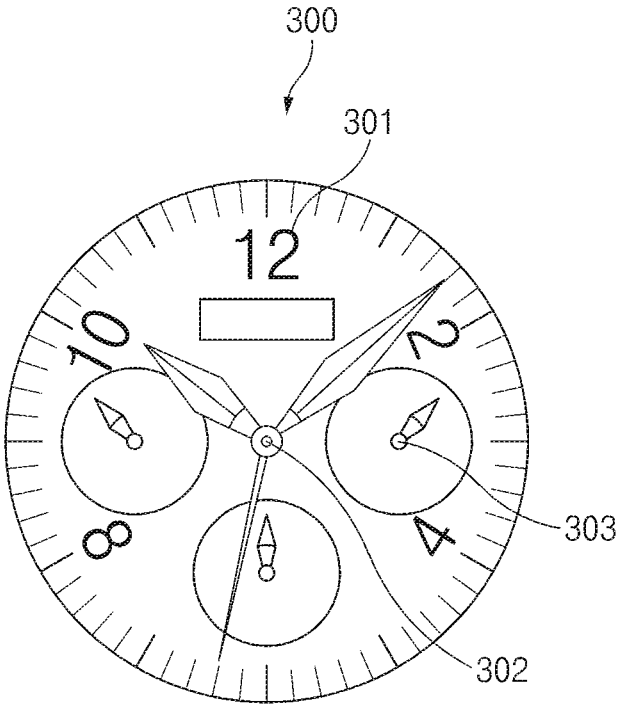
FIG. 3C is a diagram illustrating a watch screen of an electronic device according to an embodiment.

FIG. 3C is a diagram illustrating the watch screen 300 of the electronic device 101 according to an embodiment.

According to an embodiment, the electronic device 101 may operate in a wake-up mode and a sleep mode. In the sleep mode, at least part of various hardware and/software modules included in the electronic device 101 may be deactivated or may receive minimum power so as to perform only a specified restricted function. The electronic device 101 may display the watch screen 300 even in the sleep mode. The electronic device 101 may be equipped with an AOD function that always displays pieces of necessary information even in the sleep mode. The shape of the watch screen 300 displayed through the AOD function may be diverse. For example, the watch screen 300 of the electronic device 101 may display the current time and additional information in the form of an analog clock. For example, the electronic device 101 may display information on the watch screen 300 such as a calendar, weather, a battery remaining amount, missed calls, unread messages, and the like, on at least part of the display 210 depending on a user's selection. The watch screen 300 may include information such as battery states or notifications separately from the analog watch type.

According to an embodiment, the watch screen 300 may include different elements capable of being distinguished depending on characteristics, for example, a displayed criterion or a type of displayed information. For example, the watch screen 300 may include a fixed element 301, a repeating element 302, and a changing element 303. The fixed element 301, the repeating element 302, and the changing element 303 may be referred to as a first element, a second element, and a third element, respectively.

According to an embodiment, the fixed element 301 may be fixedly displayed at a specified position all the time. The fixed element 301 may display a static element that maintains a constant form in the AOD environment regardless of the state of the electronic device 101. For example, when the watch screen 300 displays an analog clock form, the fixed element 301 may display a reference scale and/or number, which constitutes an analog clock. For another example, the fixed element 301 may display a background screen maintaining a constant shape regardless of the lapse of time. The at least one processor 120 may be configured to display the fixed element 301 constituting the background screen at specified coordinates in a specified color or grayscale.

In an embodiment, the fixed element 301 may refer to an element that is substantially fixedly displayed at a predetermined location. For example, in the example described above, the reference scale and/or number constituting an analog clock may be displayed by finely changing locations thereof within a range, which it is difficult for a user to visually recognize, to reduce burn-in of pixels. In this case, in terms of a user, it may be recognized that the reference scale and number are displayed at a fixed location.

According to an embodiment, the repeating element 302 may be displayed depending on a specified rule. The specified rule may include at least one of a time point, a location, a period, or a shape at which the repeating element 302 is displayed. For example, when the watch screen 300 displays an analog clock shape, the repeating element 302 may display a second hand of which the display location is changed for each second by one unit scale interval, a minute hand of which the display location is changed for each minute by one unit scale interval, and an hour hand of which the display location is changed for each hour by one number interval. The specified rule may include information about how the shape is changed while each of the second hand, minute hand, and hour hand rotates at a specified angular velocity in process of time.

According to an embodiment, the changing element 303 may indicate information obtained through at least one sensor included in the sensor module 176 or the touch sensor 251. The changing element 303 may indicate information received through a communication circuit included in the communication module 190. For example, the changing element 303 may indicate battery remaining amount information obtained using a sensor, which measures a battery remaining amount and is included in the sensor module 176. For another example, the changing element 303 may provide a notification that a message is received through a communication circuit.

Figure 4A:
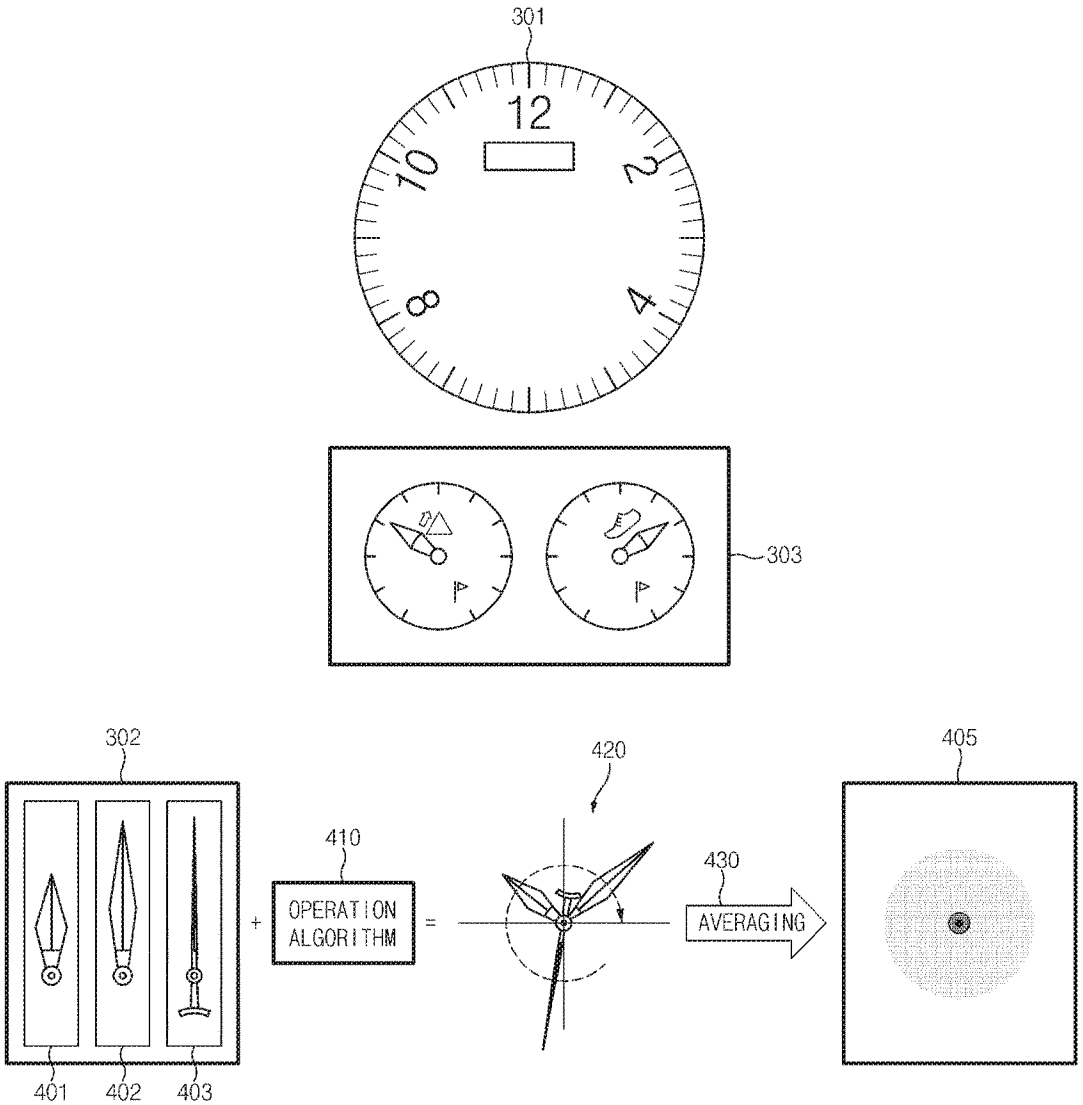
FIG. 4A is a diagram illustrating a process of generating first data using a fixed element, a changing element, or a repeating element of a watch screen according to an embodiment.

FIG. 4A is a diagram illustrating a process of generating first data 405 using the fixed element 301, the changing element 303, or the repeating element 302 of a watch screen according to an embodiment.

According to an embodiment, the at least one processor 120 may be configured such that the fixed element 301 is displayed on the watch screen 300 at specified coordinates in a specified color or grayscale. The at least one processor 120 may convert an image displayed by the fixed element 301 into image data. The at least one processor 120 may deliver the image data to the DDI 230. The at least one processor 120 may be configured such that pixels corresponding to coordinates, at which the display 210 displays the fixed element 301, emit light at a gray level for each specified color.

According to an embodiment, when the value indicating information is changed depending on an event occurring outside the electronic device 101 or the state of the electronic device 101, the at least one processor 120 may be configured to change the shape of the changing element 303. For example, when the weather information is changed from sunny to cloudy or an event of receiving a message occurs, the at least one processor 120 may be configured to change the shape of the changing element 303. For another example, when the battery state of the electronic device is changed because of the charging and discharging of the battery of the electronic device 101, the at least one processor 120 may be configured to change the shape of the changing element 303.

According to an embodiment, the at least one processor 120 may be configured such that the repeating element 302 is sequentially displayed on the watch screen 300 during a specified period in a specified shape. The at least one processor 120 may be configured such that the watch screen 300 displays the repeating element 302 at a specified location at each specified time. The at least one processor 120 may generate pieces of image data by converting each of a plurality of shapes displayed by the repeating element 302 into image data. The at least one processor 120 may deliver the pieces of image data to the DDI 230. The at least one processor 120 may be configured to sequentially display the shape of the repeating element 302 on the display 210 based on a specified rule.

According to an embodiment, the repeating element 302 may include a first repeating element 401, a second repeating element 402, and a third repeating element 403. For example, the repeating element 302 of the watch screen 300 displaying an analog clock may include an hour hand 401, a minute hand 402, and a second hand 403. The first repeating element 401 of the watch screen 300 displaying the analog clock may be referred to as the hour hand 401. The second repeating element 402 of the watch screen 300 displaying the analog clock may be referred to as the minute hand 402. The third repeating element 403 of the watch screen 300 displaying the analog clock may be referred to as the second hand 403. For example, the at least one processor 120 may generate pieces of image data respectively corresponding to all forms in which the hour hand 401, the minute hand 402, and the second hand 403 of the analog clock are capable of being represented during a specified period of 12 hours according to the analog clock.

According to an embodiment, the at least one processor 120 may generate the first data 405 by applying a rule, which is specified to calculate an average image value, from among specified rules to the repeating element 302. The first data 405 may be image data obtained by superimposing and averaging pieces of image data. For example, the hour hand 401, the minute hand 402, and the second hand 403 of the analog clock may generate a plurality of images while rotating at a constant angular velocity depending on the rule specified to calculate an average image value, and thus an image such as a circular probability distribution may be obtained when the plurality of images are superimposed and averaged.

According to an embodiment, the at least one processor 120 may apply an operation algorithm 410 included in the specified rule to the repeating element 302. For example, the at least one processor 120 may apply the operation algorithm 410 including the shape and rotational angular velocity of each of the hour hand 401, the minute hand 402, and the second hand 403, to the repeating element 302 of the watch screen 300 displaying the analog clock.

According to an embodiment, the at least one processor 120 may be configured such that the shapes displayed by the repeating element 302 are sequentially listed on the watch screen 300 during a specified period by a specified rule. The at least one processor 120 may perform superimposition 420 that all shapes capable of being represented by the repeating element 302 are sequentially arranged and superimposed. The at least one processor 120 may superimpose a plurality of images capable of being represented through the superimposition 420. For example, the at least one processor 120 may perform the superimposition 420 on all shapes capable of being represented by the hour hand 401, the minute hand 402, or the second hand 403 included in the repeating element 302 of the analog clock in process of time.

According to an embodiment, the at least one processor 120 may perform averaging 430 on a plurality of images superimposed through the superimposition 420. For example, the at least one processor 120 may represent all shapes capable of being represented by the first repeating element 401, the second repeating element 402, and the third repeating element 403 included in the repeating element 302, as probabilistic and/or statistical graphs.

According to an embodiment, the at least one processor 120 may be configured to generate the first data 405 by calculating the image obtained by performing the averaging 430 on shapes displayed during a specified period. The at least one processor 120 may generate the averaged first data 405 by superimposing the image on which the averaging 430 is performed. For example, when the rule specified to calculate the average image value by stochastically and statistically analyzing the shapes displayed during the specified period of 12 hours is applied to the hour hand 401, the minute hand 402, and the second hand 403 included in the repeating element 302 of the analog clock, the first data 405 from averaging the repeating element 302 of the analog clock may be generated. It may be seen that the hour hand 401, the minute hand 402, and the second hand 403 are uniformly distributed in a circle when the first data 405 is represented as a visual image.

Figure 4B:
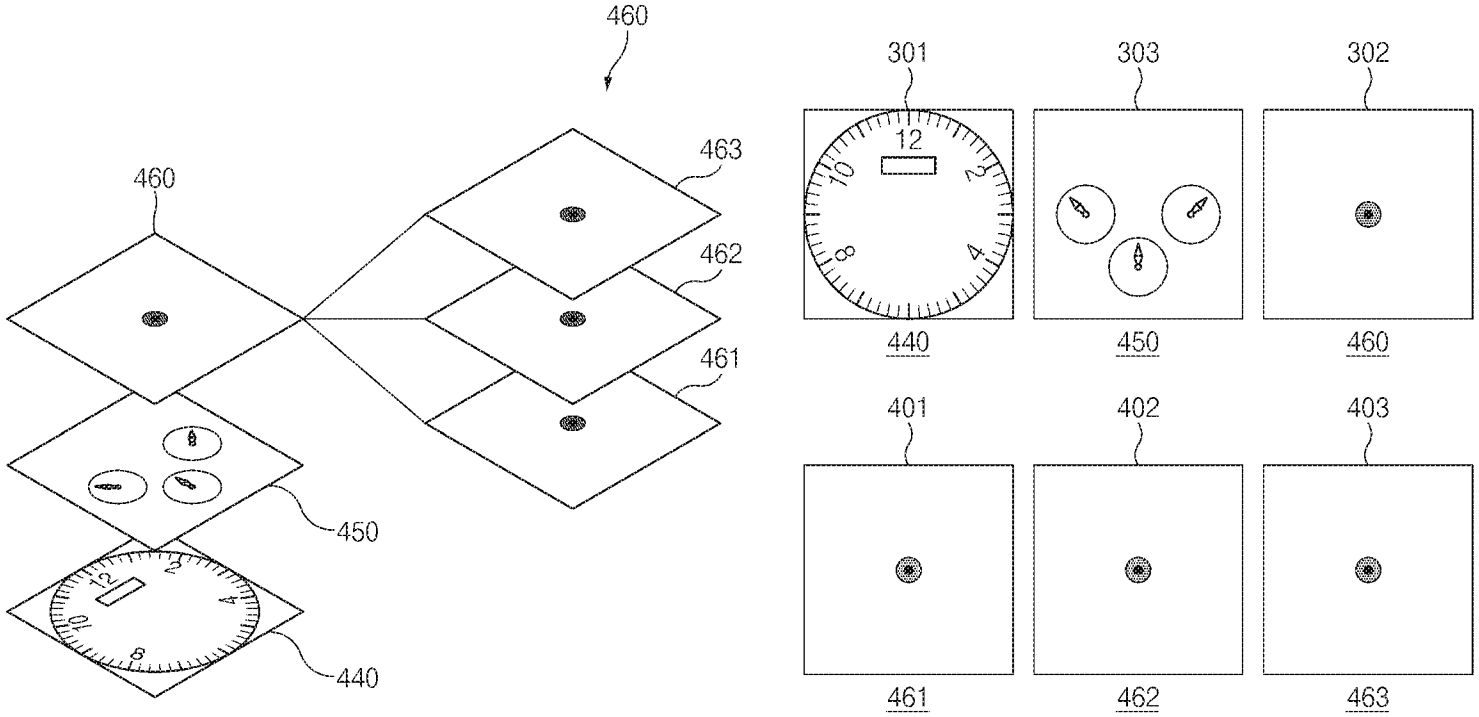
FIG. 4B is a diagram illustrating layers of a watch screen according to an embodiment.

FIG. 4B is a diagram illustrating layers 440, 450, and 460 of the watch screen 300 according to an embodiment. In an embodiment, the watch screen 300 may include the first layer 440 including the fixed element 301, the second layer 450 including the changing element 303, and the third layer 460 including the repeating element 302. In other words, the display 210 may superimpose the first layer 440, the second layer 450, and the third layer 460 and may display the superimposed image as the watch screen 300.

According to an embodiment, the first layer 440 may display the fixed element 301. For example, on the watch screen 300 displaying an analog clock, the first layer 440 may display reference scales and numbers of the clock.

According to an embodiment, the second layer 450 may display the changing element 303. For example, the second layer 450 may display information other than battery remaining amount, temperature, or time on the watch screen 300 displaying the analog clock.

According to an embodiment, the third layer 460 may display the repeating element 302. For example, the third layer 460 may display the hour hand 401, the minute hand 402, and the second hand 403 on the watch screen 300 displaying the analog clock. In another example, the third layer 460 sequentially displays the repeating element 302, the third layer 460 may display an image corresponding to the first data 405 obtained by performing the averaging 430 on the repeating element 302.

According to an embodiment, the shape of the repeating element 302 may continuously change depending on a specified rule. When the repeating element 302 and the fixed element 301 are displayed on the same layer, it is necessary to supply up to data for the form that is not continuously changed, thereby increasing power consumption in a procedure of processing data. Besides, when the repeating element 302 and the changing element 303 are displayed on the same layer, the repeating element 302 may not be changed depending on the rule specified when the shape of the changing element 303 is changed, and may be affected by the changing element 303. Accordingly, it may not be easy to implement the shape of the repeating element 302. When the repeating element 302 is displayed as a separate layer, power consumption may be reduced, and thus it may be easy to implement the shape of the repeating element 302.

According to an embodiment, the third layer 460 indicating the repeating element 302 may include one or more sub-layers 461, 462, and 463. For example, the third layer 460 may include the first sub-layer 461, the second sub-layer 462, and the third sub-layer 463.

According to an embodiment, each of the first repeating element 401, the second repeating element 402, and the third repeating element 403 may be displayed on the plurality of sub-layers 461, 462, and 463, respectively. For example, among the repeating element 302 of the watch screen 300 displaying an analog clock, the hour hand 401 may be displayed on the first sub-layer 461; the minute hand 402 may be displayed on the second sub-layer 462; the second hand 403 may be displayed on the third sub-layer 463.

According to an embodiment, the hour hand 401, the minute hand 402, and the second hand 403 may have different display times and locations from one another. For example, the hour hand 401 may rotate by 30 degrees for 1 hour; the minute hand 402 may rotate by 360 degrees for 1 hour; the second hand (403) may rotate by 360 degrees for 1 minute. The averaged shape of each of the hour hand 401, the minute hand 402, and the second hand 403 may be a circle shape (e.g., a concentric circle), and the individual shapes of the averaged circular image may be different from one another. As such, each of the sub-components having different specified rules in the repeating element 302 may be displayed on the different sub-layers 461, 462, and 463.

Figure 5A:
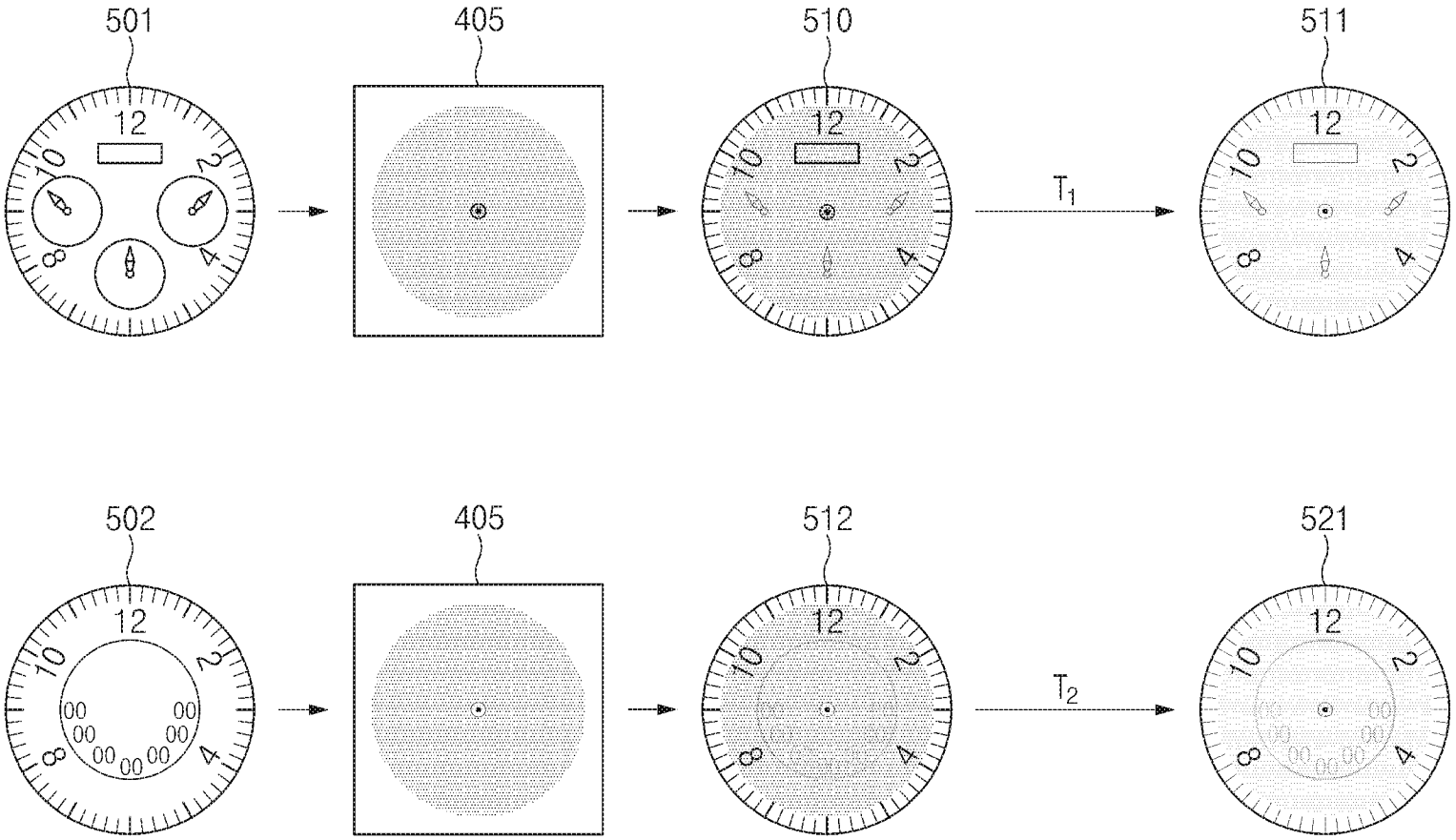
FIG. 5A is a diagram illustrating a process of generating deterioration information of a watch screen according to an embodiment.

FIG. 5A is a diagram illustrating a process of generating deterioration information 511, 512, and 521 of the watch screen 300 according to an embodiment.

According to an embodiment, the at least one processor 120 may generate the first data 405 based on the specified rule and the shape of the repeating element 302. The specified rule may include the operation algorithm 410. The at least one processor 120 may collect all shapes capable of being displayed by the repeating element 302. At least one processor may generate the first data 405 by superimposing and averaging the collected shapes.

According to an embodiment, the at least one processor 120 may change the shape of the changing element 303 in response to the event that the changing element 303 is changed from a first value to a second value. The first value of the changing element 303 may be a value indicating information associated with the current state of the electronic device 101. The second value of the changing element 303 may be a value indicating information obtained by the electronic device 101 depending on a specified event. For example, when the changing element 303 indicates battery information, the first value of the changing element 303 may be a value indicating the extent to which the battery of the electronic device 101 is currently charged. When an event that a battery remaining amount decreases due to a user's usage, gradual discharge, or the like, or the battery remaining amount increases through charging is obtained, the second value of the changing element 303 may be a value indicating the extent to which the battery is charged. For example, when the extent to which the battery of the electronic device 101 is charged decreases from 80% to 79%, the shape of the changing element 303 may be changed from a shape indicating the first value of 80% to a shape indicating the second value of 79%.

According to an embodiment, the at least one processor 120 may generate second data 501 based on the fixed element 301 and the changing element 303 in response to an event that the changing element 303 is changed from the first value to the second value. When the changing element 303 is changed from the first value to the second value, the at least one processor 120 may sample the shape of the fixed element 301 and the shape of the changing element 303. The at least one processor 120 may generate image data corresponding to the sampled image. For example, the at least one processor 120 may sample current values supplied to the pixels of the display 210 for displaying the fixed element 301 and the changing element 303 when the changing element 303 is changed from the first value to the second value. The at least one processor 120 may generate image data corresponding to the sampled current values.

According to an embodiment, the at least one processor 120 may generate first deterioration information 511, based on the first data 405, the second data 501, and a time T1 during which the changing element 303 retains the first value. The first deterioration information 511 may be image data for compensating for the deterioration caused by the fixed element 301, the repeating element 302, and the changing element 303 during the time T1 during which the changing element 303 retains the first value. As the corresponding image is displayed on the display 210, the first deterioration information 511 may be associated with the extent to which the pixels of the display 210 are deteriorated or burned in. The first deterioration information 511 may be a value indicating the extent to which pixels are deteriorated, and may be a value obtained by predicting or measuring the extent to which each pixel is deteriorated, when the watch screen 300 displays the corresponding image.

According to an embodiment, the at least one processor 120 may generate basic deterioration information 510 for compensating for deterioration occurring when the watch screen 300 displays an image, by combining the first data 405 and the second data 501. The at least one processor 120 may generate the first deterioration information 511 by reflecting the time T1, during which the changing element 303 retains the first value, to the basic deterioration information 510.

According to an embodiment, the electronic device 101 may compensate for the deterioration caused by an image displayed on the watch screen 300, during the time T1 during which the changing element 303 retains the first value after the changing element 303 is changed from the first value to the second value by using the first deterioration information 511. For example, the at least one processor 120 may deliver the generated first image to the DDI 230 after performing afterimage compensation. For another example, the at least one processor 120 may deliver the first deterioration information 511 to the DDI 230 and may allow the DDI 230 to compensate for the deterioration caused by the image displayed on the watch screen 300.

According to an embodiment, when performing afterimage compensation using the first deterioration information 511, the DDI 230 may compensate for an afterimage caused by deterioration generated in the display 210 during the time T1 during which the changing element 303 retains the first value. For example, when the result of calculating the degree of deterioration of the pixel of the display 210 with reference to the first deterioration information 511 indicates that it is calculated that the first pixel among the pixels of the display 210 is deteriorated by 10% and the second pixel thereof is deteriorated by 20%, the DDI 230 may increase first pixel data corresponding to the first pixel by 100/90 and may increase second pixel data corresponding to the second pixel by 100/80. For another example, the DDI 230 may compensate for an afterimage due to the deterioration in the manner of reducing pixel data corresponding to a pixel having a small degree of deterioration.

According to an embodiment, the time at which the afterimage according to the deterioration occurring during the time T1 during which the changing element 303 retains the first value is compensated may be an arbitrary time after the time T1, during which the changing element 303 retains the first value, expires. For example, the at least one processor 120 may perform the afterimage compensation immediately after the time T1, during which the changing element 303 retains the first value, expires. For another example, the at least one processor 120 may perform afterimage compensation after the display 210 is turned off without displaying a screen. The DDI 230 may store the first deterioration information 511 in a memory (e.g., the memory 233 of FIG. 2). Afterward, the DDI 230 may compensate for an afterimage due to deterioration by supplying pixel data according to the first deterioration information 511 at a point in time when the display 210 is turned off.

According to an embodiment, the at least one processor 120 may generate third data 502 based on the fixed element 301 and the changing element 303 in response to an event that the changing element 303 is changed from the second value to the third value. When the changing element 303 changes from a second value to a third value, a method of generating the third data 502 may be substantially the same as the method of generating the second data 501. For example, when the changing element 303 indicates the extent to which the battery of the electronic device 101 is charged, and the extent to which the battery of the electronic device 101 is charged decreases from 79% to 78%, the shape of the changing element 303 may be changed from a shape indicating the second value of 79% to a shape indicating the third value of 78%.

According to an embodiment, the at least one processor 120 may generate second deterioration information 512, based on the first data 405, the third data 502, and a time T2 during which the changing element 303 retains the second value. The method of generating the second deterioration information 512 may be substantially the same as the method of generating the first deterioration information 511.

According to an embodiment, the at least one processor 120 may be configured to accumulate the second deterioration information 512 in the first deterioration information 511. When the at least one processor 120 generates the second deterioration information 512 while not performing the afterimage compensation according to the first deterioration information 511, the at least one processor 120 may accumulate the second deterioration information 512 in the first deterioration information 511 to perform both the afterimage compensation according to the first deterioration information 511 and the afterimage compensation according to the second deterioration information 512. The at least one processor 120 may generate third deterioration information 521 by accumulating the second deterioration information 512 in the first deterioration information 511.

According to an embodiment, the at least one processor 120 may compensate for the deterioration caused by an image displayed on the watch screen 300, during the time T2 during which the changing element 303 retains the second value, using the third deterioration information 521. When performing afterimage compensation using the third deterioration information 521, it is possible to compensate for an afterimage caused by deterioration generated in the display 210 during the time T2 during which the changing element 303 retains the second value.

According to an embodiment, as the time T2 during which the changing element 303 retains the second value increases, the at least one processor 120 may increase the reflection ratio of the second deterioration information 512 depending on the time T2 during which the second value is maintained, as compared with the time T1 during which the first value is maintained. As the time T2 during which the changing element 303 retains the second value increases, the amount of deterioration occurring by displaying the changing element 303 may increase. To compensate for the deterioration caused by the changing element 303, the at least one processor 120 may generate the third deterioration information 521 obtained by increasing the reflection ratio of the second deterioration information 512 as the time T2 during which the changing element 303 retains the second value increases.

Figure 5B:
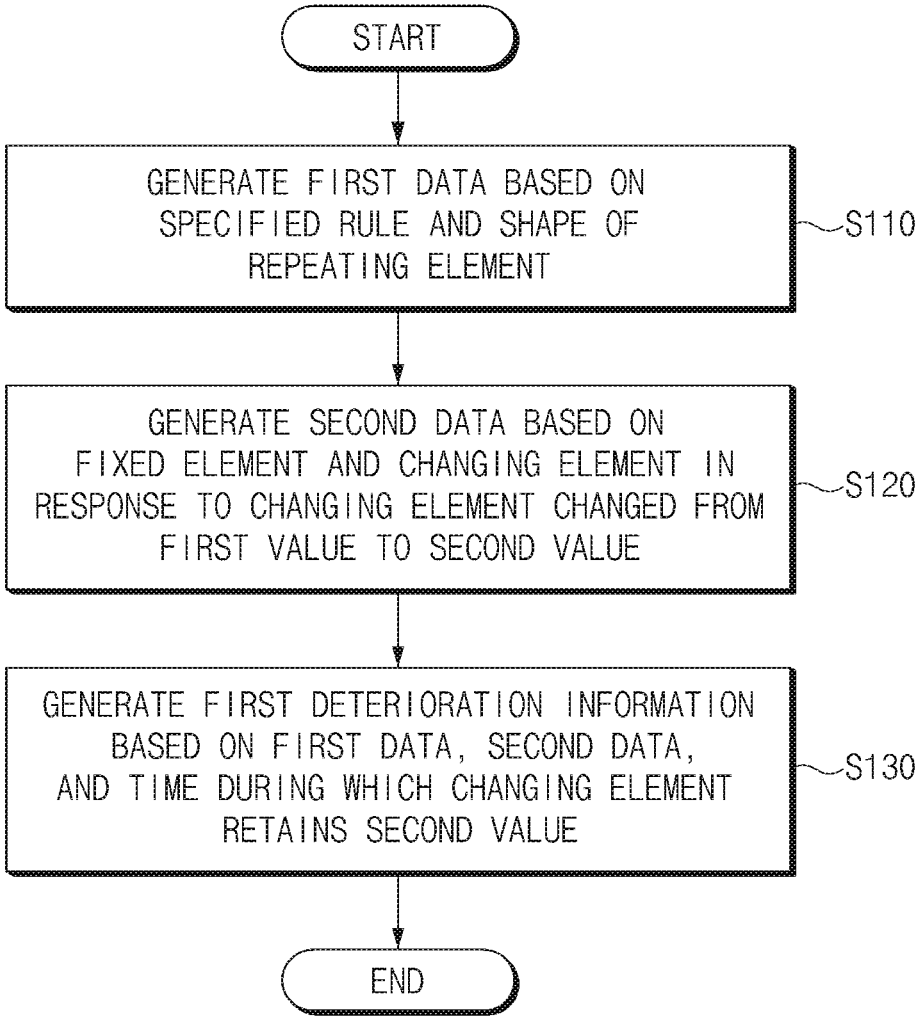
FIG. 5B is a flowchart illustrating a process of generating deterioration information of a watch screen according to an embodiment.

FIG. 5B is a flowchart illustrating a process of generating deterioration information of the watch screen 300 according to an embodiment.

In the electronic device 101 according to an embodiment, in operation S110, the at least one processor 120 may generate the first data 405 based on the specified rule and the shape of the repeating element 302. The specified rule may include the operation algorithm 410 that determines the change history of the shape of the repeating element 302. The at least one processor 120 may generate the first data 405 by performing the superimposition 420 and the averaging 430 on the shape of the repeating element 302 based on the specified rule. The at least one processor 120 may generate the first data 405 associated with the degree of deterioration, which is the extent to which the display 210 is deteriorated, by displaying the repeating element 302 on the display 210.

According to an embodiment, in operation S120, the electronic device 101 may generate the second data 501 based on the fixed element 301 and the changing element 303 in response to an event that the changing element 303 is changed from the first value to the second value. When the event that the changing element 303 is changed from the first value to the second value occurs, the at least one processor 120 may sample the first image including the at least one first image object formed by the fixed element 301 and the changing element 303. The at least one processor 120 may generate the second data 501 associated with the degree of deterioration of the display 210 according to displaying the sampled first image.

According to an embodiment, in operation S130, the electronic device 101 may generate the first deterioration information 511, based on the first data 405, the second data 501, and the time T1 during which the changing element 303 retains the second value. The at least one processor 120 may generate the basic deterioration information 510 capable of compensating for the afterimage occurring to correspond to the shape of the watch screen 300, by combining the first data 405 and the second data 501. The at least one processor 120 may generate the first deterioration information 511 by reflecting the time T1, during which the changing element 303 retains the second value, to the basic deterioration information 510.

According to various embodiments, the electronic device 101 may include at least one sensor (e.g., the sensor module 176 of FIG. 2), a communication circuit (e.g., the communication module 190 of FIG. 1), a display 210, and at least one processor 120 operationally connected to the display 210. The at least one processor 120 may be configured to display, on the display 210, a watch screen 300 including a fixed element 301 displayed at a specified location of the display 210, a repeating element 302 displayed based at least on a pre-defined rule, and a changing element 303 associated with information obtained through the at least one sensor 176 or received through the communication circuit 190, to generate first data 405 based on at least one of the pre-defined rule or a shape of the repeating element 302, to generate second data 501 based on at least one of the fixed element 301 or the changing element 302 in response to the changing element 303 changed from a first value to a second value, and to generate first deterioration information 511 based on the first data 405, the second data 501, and a time T1 during which the changing element retains the first value.

According to an embodiment, the first deterioration information 511 may be generated based on at least one of a luminance of the display 210 or a temperature of the display 210 at a time point at when the watch screen 300 is displayed.

According to an embodiment, the at least one processor 120 may be configured to generate third data based on the fixed element 301 and the changing element 302 in response to the changing element 303 changed from the second value to a third value and to generate third deterioration information 521 by accumulating second deterioration information 512 generated based on the first data 405, the third data 502, and a time T2, during which the changing element 303 retains the second value, in the first deterioration information 511.

According to an embodiment, the at least one processor 120 may be configured to list a shape of the repeating element 302 displayed during a specified period by the pre-defined rule and to generate first data 405 by calculating a statistical average value of the shape displayed during the period.

According to an embodiment, the at least one processor 120 may be configured to sample at least one image of the fixed element 301 or the changing element 303 of the watch screen 300 in response to the changing element 303 changed from a first value to a second value or to sample a current flowing into the display 210.

According to an embodiment, the at least one processor 120 may be configured to generate the third deterioration information 511 by increasing a reflection ratio of the second deterioration information 512 depending on a time T2 during which the second value is retained as compared with a time T1 during which the first value is retained as the time T2 during which the changing element 303 retains the second value increases.

According to an embodiment, the display 210 may include a plurality of layers 440, 450, and 460 disposed on different layers from one another. A first layer 440 among the plurality of layers 440, 450, and 460 may display the fixed element 301. A second layer 450 among the plurality of layers 440, 450, and 460 may display the changing element 303. A third layer 460 among the plurality of layers 440, 450, and 460 may display the repeating element 302. The third layer 460 may include a plurality of sub-layers 461, 462, and 463 disposed on different layers.

According to an embodiment, the at least one processor 120 may be configured to display the fixed element 301 at specified coordinates.

According to an embodiment, the at least one processor 120 may be configured to cause an image object corresponding to the repeating element 302 to be sequentially displayed in the shape at the time and the location during the period included in the pre-defined rule.

According to an embodiment, the at least one processor 120 may be configured to change the shape of the changing element 303 when a value indicating the information is changed depending on an event occurring outside the wearable electronic device 101 or a state of the wearable electronic device 101.

According to an embodiment, as described with reference to FIGS. 3A to 5B, the electronic device 101 may be a wearable electronic device that displays the watch screen 300 in the analog form on the display 210. However, the disclosure is not limited thereto, and the electronic device 101 may be an electronic device including an AOD function. The AOD function refers to a function to display the set image (e.g., time, weather, battery states, or notifications) at low power, using the at least one processor 120 and the display 210 while power is not supplied to at least a partial configuration of the electronic device 101. The AOD is not limited to the analog type of the watch screen 300 and may display various types of screens. An embodiment is exemplified from FIG. 6A as the electronic device 101 displays a watch screen 600 according to another embodiment.

Figure 6A:
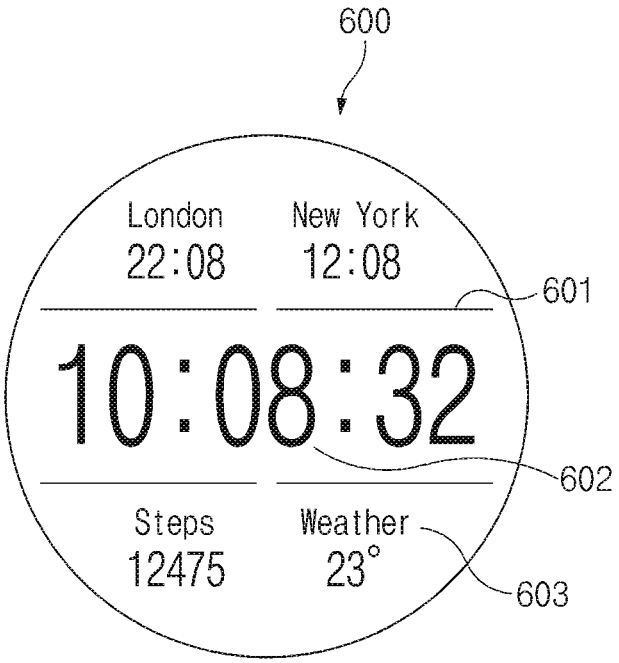
FIG. 6A is a diagram illustrating a watch screen according to another embodiment.

FIG. 6A is a diagram illustrating the watch screen 600 according to another embodiment. According to another embodiment, the watch screen 600 may be a watch screen that displays time in a digital manner. For example, the watch screen 600 according to another embodiment may display the current time of a specific country (e.g., Korea) and/or the current time of another place (e.g., world major cities such as London or New York). Furthermore, the watch screen 600 may display weather or the number of steps obtained while the wearer of the electronic device 101 walks for a day.

According to an embodiment, the watch screen 600 may include a first element 601, a second element 602, and a third element 603. For example, the watch screen 600 may include the fixed element 601, the repeating element 602, and the changing element 603.

According to an embodiment, the fixed element 601 may be an element displayed at a specified location in the watch screen 600. The fixed element 601 may be an image object that maintains a constant location and shape regardless of the lapse of time. For example, a dividing line surrounding numbers indicating time on the watch screen 600 displaying the time in a digital manner may belong to the fixed element 601. For another example, characters indicating a place, steps, or weather may belong to the fixed element 601. For still another example, colons ':' for separating the hour, minute, and second of the current time in Korea in the numbers indicating the time may belong to the fixed element 601.

According to an embodiment, the repeating element 602 may be an element of which the shape is capable of being changed by a specified rule on the watch screen 600. The repeating element 602 may be an image object for repeatedly displaying a constant pattern or shape in process of time. For example, numbers indicating the hour, minute, and second of the current time in Korea, and numbers and colons indicating the times at places other than Korea may belong to the repeating element 602.

According to an embodiment, the changing element 603 may be an element indicating event information on the watch screen 600. The changing element 603 may be an image object changed in response to specified event information. For example, the number indicating the number of steps of the wearer of the electronic device 101 increases by 1 in response to event information about the wearer's 1 step, and thus may belong to the changing element 603. For another example, the number indicating the current temperature is changed depending on the temperature at a periphery of the electronic device 101, and thus may belong to the changing element 603.

Figure 6B:
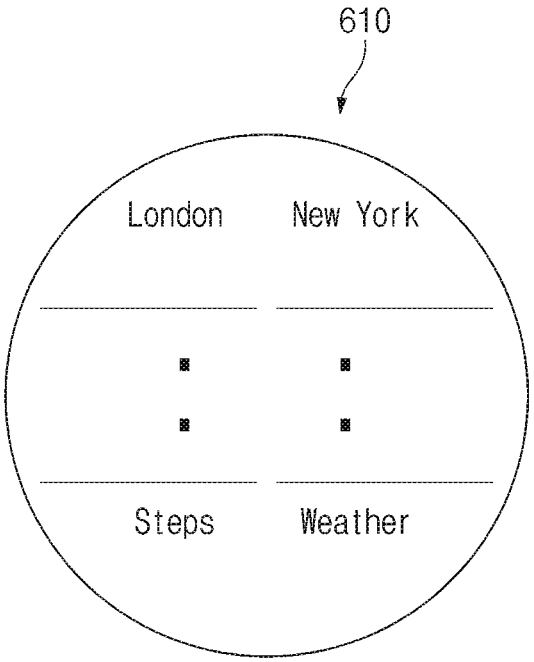
FIGS. 6B, 6C, and 6D are diagrams illustrating layers of a watch screen according to another embodiment.
Figure 6C:
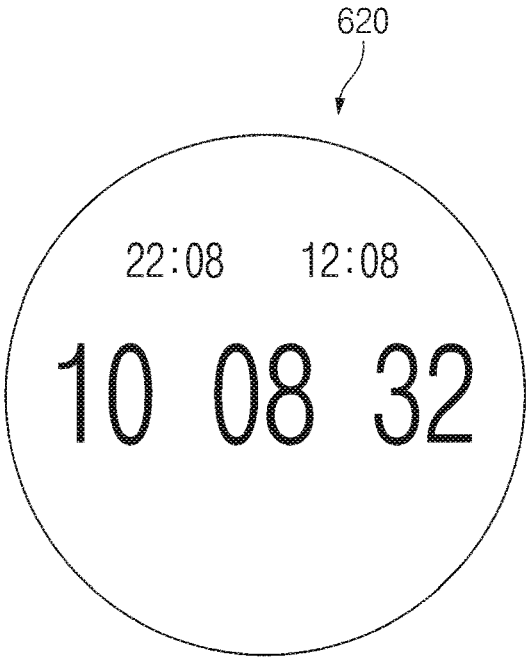
Figure 6D:
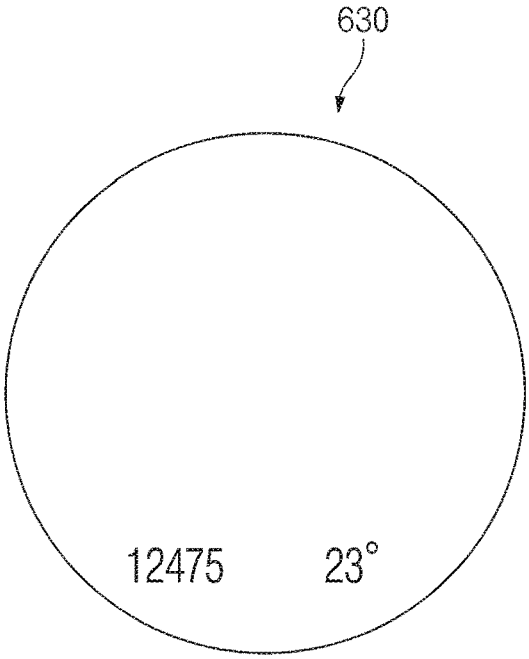

FIGS. 6B to 6D are diagrams illustrating layers 610, 620, and 630 of the watch screen 600 according to another embodiment. The watch screen 600 may include a plurality of layers 610, 620, and 630. For example, the watch screen 600 may include the first layer 610, the second layer 620, and the third layer 630.

According to an embodiment, the first layer 610 may form a lower layer of the watch screen 600; the second layer 620 may be disposed on the first layer 610; the third layer 630 may be disposed on the second layer 620. The first layer 610 may represent the fixed element 601; the second layer 620 may represent the repeating element 602; the third layer 630 may represent the changing element 603.

According to an embodiment, each of the first to third layers 610, 620, and 630 of the electronic device 101 may independently generate at least one image object. For example, the electronic device 101 may combine the fixed element 601 and the repeating element 602 to generate a first image object by simultaneously driving the adjacent first and second layers 610 and 620 among the first to third layers 610, 620, and 630, and then may generate a second image object using the changing element 603. For another example, the electronic device 101 may generate first to third image objects, using each of the fixed element 601, the repeating element 602, and the changing element 603.

According to an embodiment, the electronic device 101 may implement the watch screen 600 by superimposing one or more image objects generated by the first to third layers 610, 620, and 630. The electronic device 101 may display the watch screen 600 including all of the fixed element 601, the repeating element 602, and the changing element 603 on the display 210 by driving all of the first to third layers 610, 620, and 630.

Figure 7:
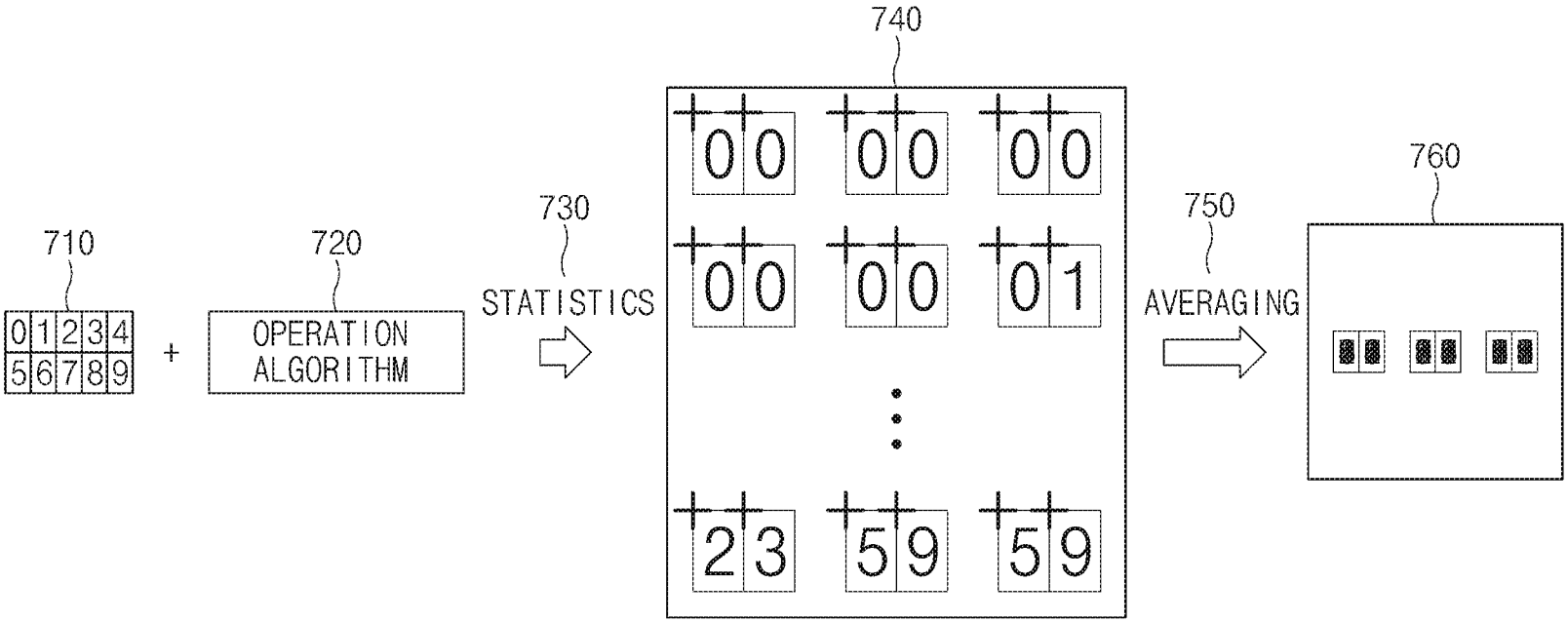
FIG. 7 is a diagram illustrating a process of generating first data using a repeating element according to another embodiment.

FIG. 7 is a diagram illustrating a process of generating first data 760 using the repeating element 602 of the watch screen 600 according to another embodiment.

According to an embodiment, the at least one processor 120 may be configured to make catalog 710 by listing all shapes of one or more image objects capable of being displayed by the repeating element 602 of the watch screen 600. For example, when the watch screen 600 has a clock shape displaying time in a digital manner, an image object constituting the repeating element 602 may be numbers from 0 to 9. The at least one processor 120 may sequentially make the catalog 710 with respect to 10 shapes in which the numbers from 0 to 9 are listed.

According to an embodiment, the at least one processor 120 may apply an operation algorithm 720 for determining at least one of a display order, a display location, a display time, and a display shape, to the repeating element 602 obtained by making the catalog 710. For example, when the watch screen 600 has a clock shape displaying time in a digital manner, the at least one processor 120 may display the current time on the watch screen 600, using image objects in the form of numbers from 0 to 9. The at least one processor 120 may change the shape of an image object indicating a second for each second depending on the operation algorithm 720 including an internal clock.

According to an embodiment, the at least one processor 120 may make statistics 730 with respect to all images 740 represented by the combination of one or more image objects capable of being represented through the repeating element 602. The at least one processor 120 may list all the images 740. For example, when the watch screen 600 has a clock shape displaying time in a digital manner, the at least one processor 120 may list all types of images capable of being represented at intervals of one second for 24 hours from midnight to the next midnight. Afterward, the statistics 730 may be made by reflecting the time at which each of the images 740 is displayed. In the case of a watch, each of the images lasts for 1 second, all the images 740 may be displayed on the watch screen 600 to the uniform extent.

According to an embodiment, the at least one processor 120 may generate the first data 760 by making averaging 750 with respect to all the images 740 obtained by making the statistics 730 on the repeating element 602. The at least one processor 120 may superimpose all the images 740 on the watch screen 600. The at least one processor 120 may make the averaging 750 by reflecting the time during which each of the superimposed images 740 is displayed. The at least one processor 120 may set a virtual image obtained by making the averaging 750 with respect to the repeating element 602 to the first data 760.

Figure 8A:
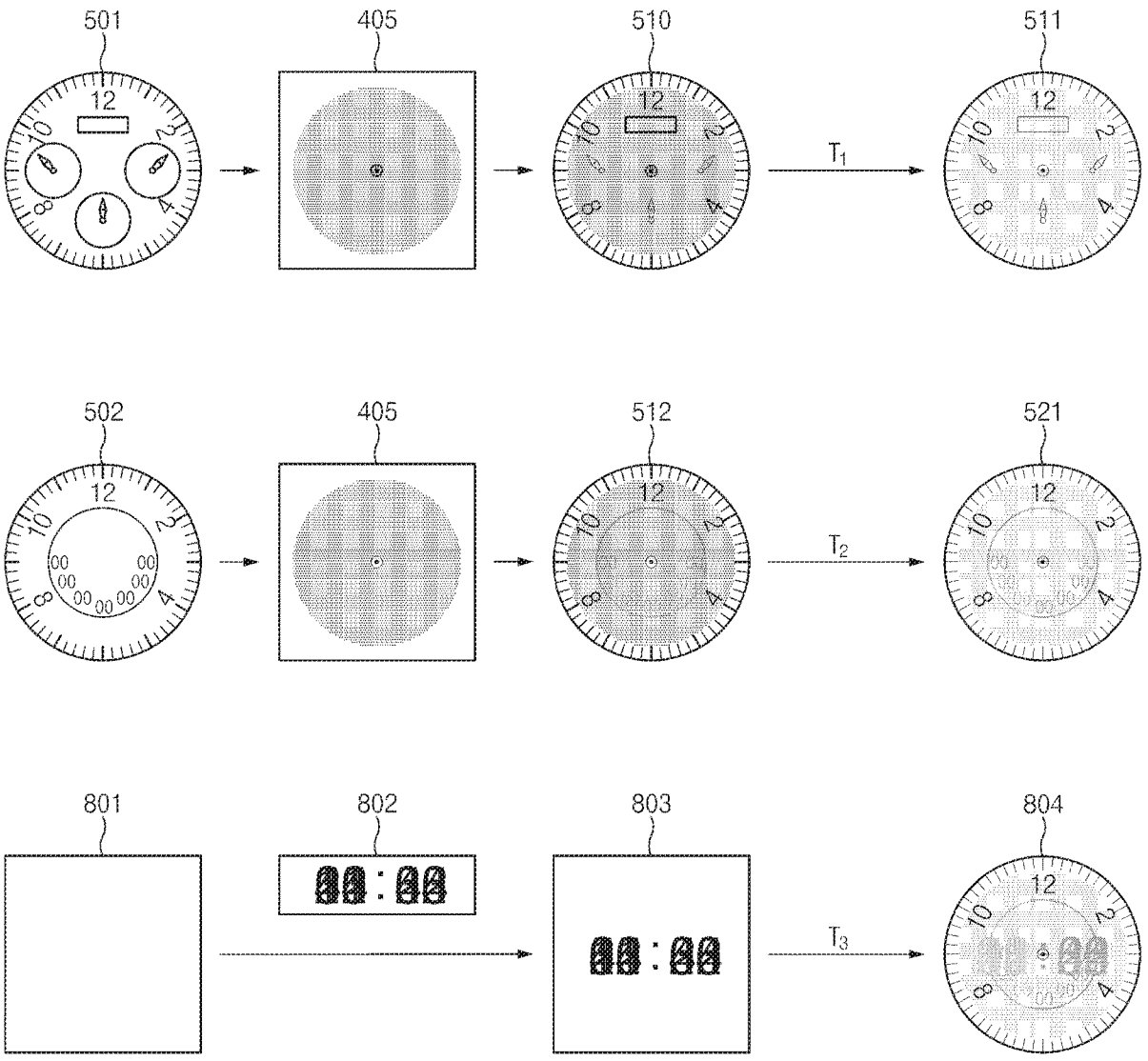
FIG. 8A is a diagram illustrating a process of generating deterioration information of a watch screen according to another embodiment.

FIG. 8A is a diagram illustrating a process of generating deterioration information of the watch screen 600 according to another embodiment. A process of generating deterioration information according to another embodiment may be a process of generating deterioration information after deterioration information of the watch screen 300 described with reference to FIG. 5A is generated. Accordingly, the descriptions about the generation of deterioration information of the watch screen 300 described with reference to FIG. 5A will be omitted below.

According to an embodiment, the at least one processor 120 may update first data 802 in response to an event that the repeating element 602 is changed to another shape. For example, when the watch screen 600 is changed from an analog clock shape to digital clock shape, the at least one processor 120 may update the first data 405 corresponding to the analog clock shape to the first data 802 corresponding to the digital clock shape.

According to an embodiment, the at least one processor 120 may update the third data 502 to a fourth data 801 in response to the specified event information. The specified event information may change the shape of the watch screen 600. For example, when the watch screen 600 is changed from an analog clock shape to digital clock shape, the at least one processor 120 may update the third data 502 to the fourth data 801 in the manner of changing at least one of the display shapes or display locations of fixed scales displayed by the fixed element 301 and the changing element 303 and other displayed image objects.

According to an embodiment, the at least one processor 120 may generate fourth deterioration information 803 based on the time T3 during which the shape of the watch screen 600 is changed, in response to the updated first data 802, the updated fourth data 801, and the specified event information. The method of generating the fourth deterioration information 803 may be substantially the same as the method of generating the second deterioration information 512.

According to an embodiment, the at least one processor 120 may be configured to accumulate the fourth deterioration information 803 in the third deterioration information 521. When the at least one processor 120 generates the fourth deterioration information 803 while not performing the afterimage compensation according to the third deterioration information 521, the at least one processor 120 may accumulate the fourth deterioration information 803 in the third deterioration information 521 to perform both the afterimage compensation according to the third deterioration information 521 and the afterimage compensation according to the fourth deterioration information 803. The at least one processor 120 may generate fifth deterioration information 804 by accumulating the fourth deterioration information 803 in the third deterioration information 521.

According to an embodiment, the at least one processor 120 may compensate for the deterioration caused by an image displayed on the watch screen 600, in response to the specified event information using the fifth deterioration information 804. The fifth deterioration information 804 may be data obtained by accumulating respective deterioration information 510, 512, or 803 at the rate of the displayed time T1, T2, or T3. When afterimage compensation is performed using the fifth deterioration information 804, the at least one processor 120 may compensate for an afterimage caused by the deterioration generated in the display 210 during the total cumulative time (T1+T2+T3) when the shape of the watch screen 600 is changed.

Figure 8B:
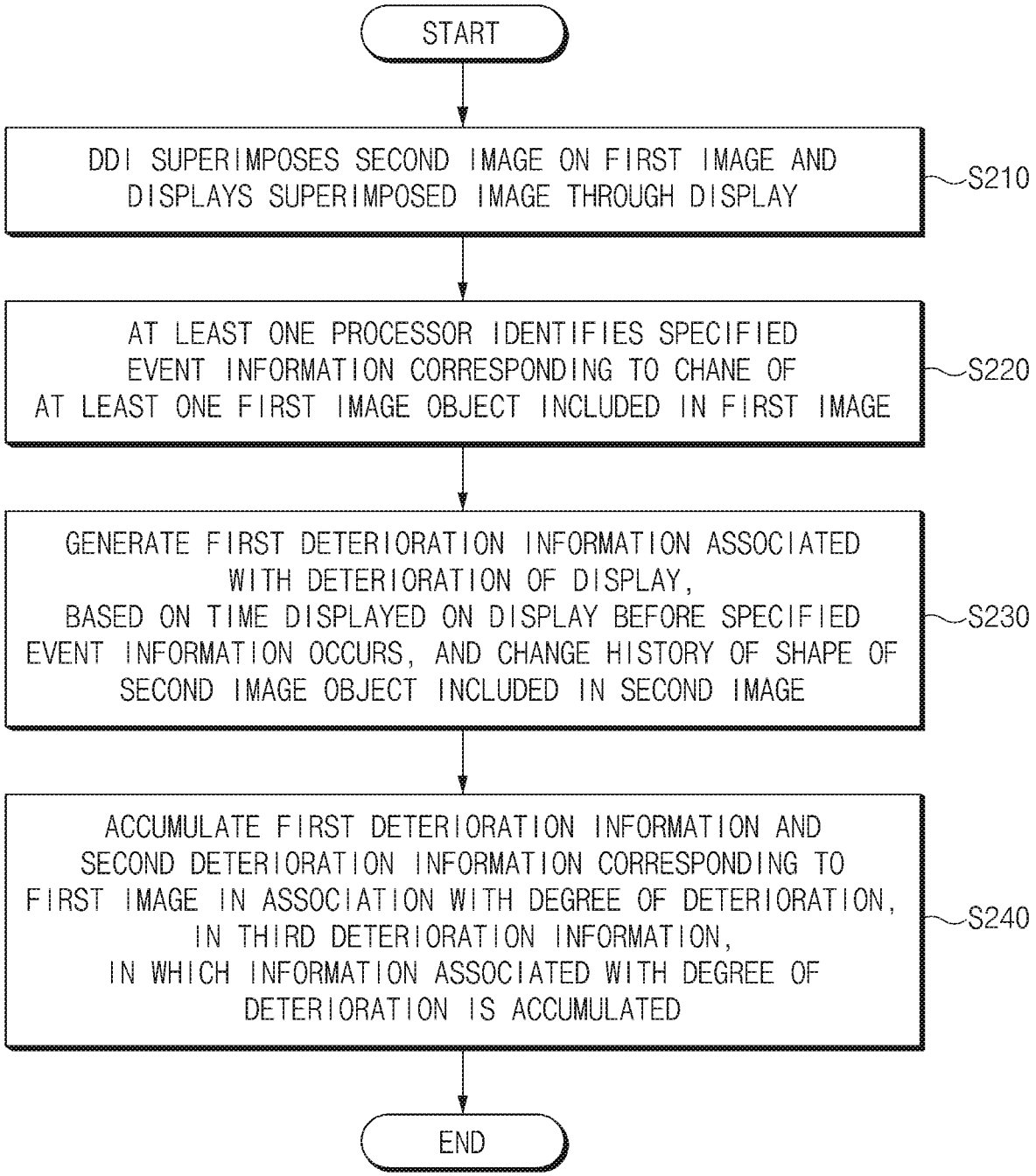
FIG. 8B is a flowchart illustrating a process of generating deterioration information of a watch screen according to an embodiment.

FIG. 8B is a flowchart illustrating a process of generating deterioration information of the watch screen 600 according to another embodiment.

In the electronic device 101 according to an embodiment, in operation S210, the DDI 230 may superimpose a second image on a first image and then may display the superimposed image through the display 210. The first image may include at least one first image object. The at least one first image object may display event information. The event information may be a user input entered through the sensor module 176 or information entered through the communication module 190. The second image may include at least one second image object. The shape of the at least one second image object may be changed. For example, the shape of the at least one second image object may be sequentially changed depending on a specified rule.

According to an embodiment, the first image and the second image may be displayed on different layers of the display 210. The shape of the first image may be changed by entering the event information. The shape of the second image may be changed depending on the specified rule regardless of the event information. The first image and the second image may be displayed on different layers of the display 210, and thus the shapes may be changed independently.

In the electronic device 101 according to an embodiment, in operation S220, the at least one processor 120 may identify the specified event information corresponding to the change of the at least one first image object included in the first image. When detecting the user input through the sensor module 176, the at least one processor 120 may determine that the specified event information occurs and may change the shape of the at least one first image object. For example, when a user walks, the at least one processor 120 may change the shape of the first image object by increasing the number indicating the total number of steps among the shapes of the watch screen 600 by one. For another example, when receiving information through the communication module 190, the at least one processor 120 may determine that the specified event information occurs and may change the shape of the at least one first image object.

In operation S230, the electronic device 101 according to an embodiment may generate the first deterioration information 511 associated with the deterioration of the display 210, based on the time displayed on the display 210 before the specified event information occurs, and the change history of the shape of the second image object included in the second image. The first deterioration information 511 may compensate for the afterimage caused by the deterioration of the display 210. To compensate for the deterioration caused by the image displayed before the specified event information occurs, the at least one processor 120 may reflect the time displayed on the display 210 before the specified event information occurs. The shape of the second image object may be changed depending on the specified rule, and thus the at least one processor 120 may generate the first deterioration information 511 by reflecting the change history of the shape of the second image object.

In operation S240, the electronic device 101 according to an embodiment may accumulate the first deterioration information 511 and the second deterioration information 512 in the third deterioration information 521. The second deterioration information 512 may be information corresponding to the first image in association with the degree of deterioration. The second deterioration information 512 may be information for compensating for the deterioration due to the first image changed because the specified event information occurs. The third deterioration information 521 may be information for compensating for the deterioration due to an image displayed by the watch screen 600.

The electronic device 101 according to an embodiment may update information for compensating for the deterioration by accumulating the first deterioration information 511 and the second deterioration information 512 in the third deterioration information 521. The first deterioration information 511 may reflect the change history of the shape of the second image object, and thus it may be possible to accurately compensate for the deterioration caused by the second image object without repeatedly updating the second image object. Furthermore, when the specified event occurs, the second deterioration information 512 may be updated. When the specified event occurs, the third deterioration information 521 may be updated. Accordingly, it may be possible to accurately compensate for the deterioration due to the image displayed on the watch screen 600.

Furthermore, according to an embodiment disclosed in this specification, the electronic device 101 may include a display 210, a display driver integrated circuit (DDI) 230 for displaying a first image including at least one first image object 501, 502, or 801 indicating event information and a second image 405 or 802 including at least one second image object, of which a shape is capable of being changed, through the display while the second image 405 or 802 is superimposed on the first image 501, 502, or 801, and at least one processor 120. The at least one processor 120 may be configured to identify specified event information corresponding to a change in the at least one first image object, to update the at least one first image object in response to the specified event information, to generate first deterioration information 511 associated with a deterioration degree of the display 210 in response to the specified event information based on a time displayed through the display before the specified event information is generated, and a change history of the shape of the at least one second image object during the time, and to accumulate the first deterioration information 511 and second deterioration information corresponding to the first image 501, 502, or 801 in associated with the deterioration degree, in third deterioration information 521, in which information associated with the deterioration degree is accumulated.

According to an embodiment, a change of the shape of the second image object may be based on a rule (e.g., the operation algorithm 720) in which at least one of a location of the second image object or a form of the second image object is specified.

According to an embodiment, at least one of a form of the shape, a location of the shape, or an angle of the shape of the second image object may be changed repeatedly.

According to an embodiment, the at least one processor 120 may be configured to change a display location of the first image 501, 502, or 801 displayed at a specified location when responding to the specified event information.

According to an embodiment, the at least one processor 120 may be configured to compensate for an image displayed on the display 210 based on the third deterioration information 521 to transmit the compensated image to the DDI 230.

According to an embodiment, the at least one processor 120 may be configured to transmit the third deterioration information 521 to the DDI 230 such that the DDI 230 compensates for an image to be displayed on the display 210 based on the third deterioration information 521.

Figure 9:
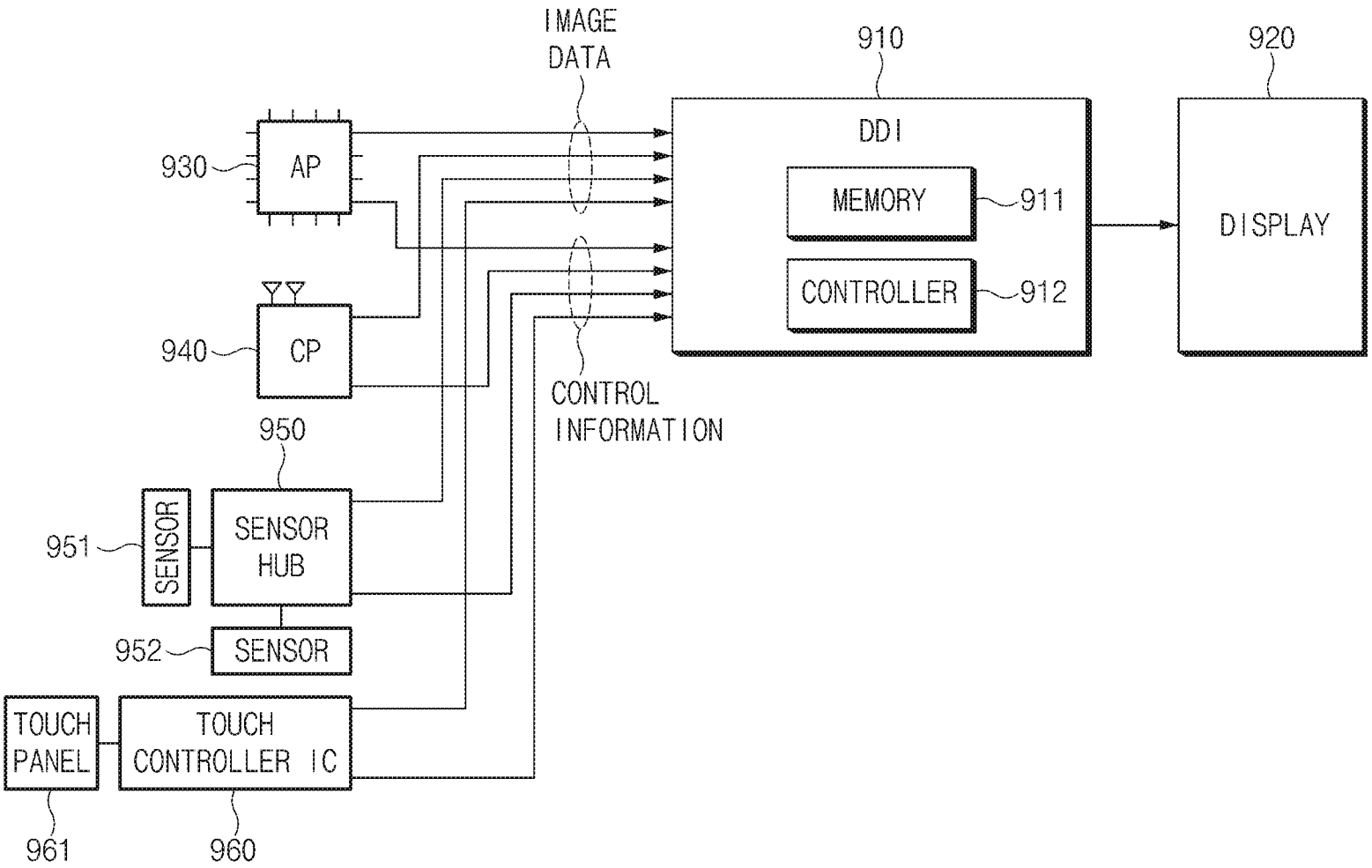
FIG. 9 is a block diagram illustrating an electronic device, according to an embodiment.

FIG. 9 is a block diagram illustrating the electronic device 101 according to an embodiment. The electronic device 101 may include at least one processor 930, 940, 950, or 960, a display 920, and a DDI 910.

According to an embodiment, the at least one processor 930, 940, 950, or 960 may include at least one or more of the application processor (AP) 930, the communication processor (CP) 940, the sensor hub 950, and/or the touch controller IC 960 driving a touch panel 961. In FIGS. 3A to 8B, it is mainly described that the at least one processor 930, 940, 950, or 960 performs the role of the AP 930. However, the at least one processor 930, 940, 950, or 960 is not limited to the AP 930, and may also perform functions of the above-described other control circuits. In another embodiment, at least one processor may be individually or comprehensively referred to as at least one or more of a DDI (e.g., the DDI 910) and/or the AP 930.

According to an embodiment, the at least one processor 120 may include a display controller, a modulator, and a transmission side (Tx) high speed serial interface (HiSSI).

According to an embodiment, the display controller may read or generate image data stored in the memory (e.g., 130 in FIG. 1). The image data may represent a screen image according to an activity of an application program. The image data may include data indicating a user authentication screen of an application (e.g., payment applications or bank/security applications requiring the highest level of security) to which the security policy of a specified level range is applied, among various differentiated security levels.

According to an embodiment, the modulator may modulate the image data received from the display controller. In this specification, "modulation" may mean changing at least part (e.g., all or part) of pixel values constituting image data. For example, the modulation in the modulator may be bypassed when the display controller generates the image data modulated from the beginning. For another example, the modulation in the modulator may be bypassed even when the modulation of the image data is not required.

According to an embodiment, the at least one processor 930, 940, 950, or 960 may provide the image data and control information to be described later to the DDI 910. For example, the image data may provide the Tx HiSSI to the DDI 910. For another example, the control information may be transmitted through a Tx low speed serial interface (LoSSI).

According to an embodiment, the DDI 910 may drive the display 920. The DDI 910 may include a memory 911, a controller 912, a gamma correction circuit, and a timing controller.

According to an embodiment, the DDI 910 may receive the image data and the control information from the at least one processor 930, 940, 950, or 960 through an interface module. For example, the encoded image may be received through a reception-side (Rx) HiSSI. The control information may be received together with image data through the Rx HiSSI. For another example, the control information may be received through an Rx LoSSI separately from the image data.

According to an embodiment, the memory 911 may store the image data received through the Rx HiSSI. For example, the size of the image data may correspond to the storage space of the memory 911. For another example, the storage space of the memory 911 may correspond to the data size of a 1 frame image of the display 920. However, the disclosure is not limited thereto. When the memory 911 is implemented to include an auxiliary memory, the storage space of the memory 911 may not correspond to the data size of a 1 frame image of the display 920. The memory 911 may be referred to as a frame buffer or a buffer memory. Hereinafter, the image data stored in the memory 911 may be referred to as first image data or may be simply referred to a first image.

According to an embodiment, the controller 912 may control the overall operation of the DDI 910. For example, the controller 912 may control the luminance of the display 920 based on the command received from the at least one processor 930, 940, 950, or 960. For another example, the controller 912 may adjust and change a gamma correction curve used in the gamma correction circuit or a look-up table (LUT), to which the gamma correction curve is reflected, depending on the image to be displayed.

According to an embodiment, the gamma correction circuit may determine or generate a gamma voltage of an electrical signal corresponding to image data. The relationship between the electrical signal and the brightness of a pixel (e.g., an organic light emitting diode (OLED)) receiving the electrical signal may be non-linear. The gamma correction circuit may determine or correct the gamma voltage of the electrical signal based on the gamma correction curve indicating the non-linear relationship between the electrical signal and the brightness of a pixel, or the LUT, to which the gamma correction curve is reflected. Each of the pixels included in the display panel may display the intended image by minimizing image distortion using the gamma correction circuit.

According to an embodiment, the timing controller may generate a signal corresponding to the received image data to provide the display 920 with the signal. The signal generated by the timing controller may be supplied to a source driver and a gate driver at the specified timing at the specified frame frequency (e.g., 60 Hz).

According to an embodiment, the display 920 may include the source driver, the gate driver, and the display panel. In addition, the display 920 may include other related circuit configurations.

According to an embodiment, the source driver may supply source voltages to source lines included in the display panel. The source driver may supply the source voltage corresponding to the luminance displayed for each frame depending on a control signal supplied from the timing controller.

According to an embodiment, the gate driver may supply scan signals to scan lines included in the display panel. The gate driver may sequentially supply the scan signals to each of the scan lines depending on the control signal supplied by the timing controller.

According to an embodiment, the display panel may include a plurality of pixels. The plurality of pixels may emit light based on electrical signals received from the source driver and the gate driver. Various images may be provided to a user by the light emitted from the plurality of pixels.

According to various embodiments, the electronic device 101 may include at least one sensor (e.g., the sensor module 176 of FIG. 2), a communication circuit (e.g., the communication module 190 of FIG. 1), a display 210, and at least one processor 120 operationally connected to the display 210. The at least one processor 120 may be configured to display, on the display 210, a screen (e.g., the watch screen 300) including a first element 301 displayed at a specified location of the display, a second element 302 displayed based at least on a pre-defined rule, and a third element 303 associated with information obtained through the at least one sensor 176 or received through the communication circuit 190 and to generate deterioration information (e.g., the first deterioration information 511 of FIG. 5A) based on the first element 301, the third element 303, data (e.g., the first data 405 of FIG. 4A) obtained by applying a pre-defined rule to the second element 302, and a time in which the third element has the first value, in response to the third element 303 changed from a first value to a second value.

According to an embodiment, the data 405 obtained by applying the pre-defined rule to the second element 302 may be generated by superimposing (e.g., the superimposition 420 of FIG. 4B) and averaging 430 shapes of all cases that the second element 302 is capable of being displayed.

According to an embodiment, the screen 300 may be formed by combining the first element 301 and the third element 303 to generate a first image object including at least one first image object indicating event information, by displaying the second element 302 to generate a second image object including at least one second image object, of which the shape is capable of being changed, and by displaying the first image object and the second image object on different layers (e.g., the plurality of layers 440, 450, or 460).

According to an embodiment, the shape of the third element 303 may be changed in response to specified event information. The third element 303 may sample images of the first element 301 and the third element 303 when the shape of the third element 303 is changed.

According to an embodiment, the at least one processor 120 may be configured to accumulate the data 405 obtained by applying the pre-defined rule on the sampled data (e.g., the second data 501 or the third data 502 of FIG. 5A) and the second element, in the deterioration information 511 in response to the specified event information.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

What is claimed is:

1. An electronic device comprising:

at least one sensor;

a communication circuit;

a display; and at least one processor operationally connected to the display, wherein the at least one processor is configured to:

display, on the display, a watch screen including a fixed element displayed at a specified location of the display, a repeating element displayed based at least on a pre-defined rule, and a changing element associated with information obtained through the at least one sensor or received through the communication circuit;

generate first data based on at least one of the pre-defined rule or a shape of the repeating element;

generate second data based on at least one of the fixed element or the changing element in response to the changing element changed from a first value to a second value;

generate first deterioration information based on the first data, the second data, and a time during which the changing element retains the first value;

generate third data based on the fixed element and the changing element in response to the changing element changed from the second value to a third value; and generate third deterioration information by accumulating second deterioration information generated based on the first data, the third data, and a time, during which the changing element retains the second value, in the first deterioration information, wherein the at least one processor is further configured to generate the third deterioration information by increasing a reflection ratio of the second deterioration information depending on a time during which the second value is retained as compared with a time during which the first value is retained as the time during which the changing element retains the second value increases.

2. The electronic device of claim 1, wherein the first deterioration information is generated based on at least one of a luminance of the display or a temperature of the display at a time point at when the watch screen is displayed.

3. The electronic device of claim 1, wherein the pre-defined rule includes at least one of a time point, a location, a period, or a shape at which the repeating element is displayed, and wherein the at least one processor is configured to:

list a shape of the repeating element displayed during a specified period by the pre-defined rule; and generate the first data by calculating a statistical average value of the shape displayed during the period.

4. The electronic device of claim 1, wherein the at least one processor is configured to:

sample at least one image of the fixed element or the changing element of the watch screen in response to the changing element changed from the first value to the second value.

5. The electronic device of claim 1, wherein the display includes a plurality of layers disposed on different layers from one another, wherein a first layer among the plurality of layers displays the fixed element, a second layer among the plurality of layers displays the changing element, and a third layer among the plurality of layers displays the repeating element, and wherein the third layer includes a plurality of sub-layers disposed on different layers.

6. The electronic device of claim 1, wherein the at least one processor is configured to:

display the fixed element at specified coordinates.

7. The electronic device of claim 1, wherein the at least one processor is configured to:

cause an image object corresponding to the repeating element to be sequentially displayed in the shape at a time and the location during a period included in the pre-defined rule.

8. The electronic device of claim 1, wherein the at least one processor is configured to:

change the shape of the changing element when a value indicating the information is changed depending on an event occurring outside the electronic device or a state of the electronic device.

* * * * *